US011146891B1

(12) United States Patent
Porter et al.

(10) Patent No.: US 11,146,891 B1
(45) Date of Patent: Oct. 12, 2021

(54) MICROELECTROMECHANICAL SYSTEM COIL ASSEMBLY FOR REPRODUCING AUDIO SIGNALS

(71) Applicant: Facebook Technologies, LLC, Menlo Park, CA (US)

(72) Inventors: Scott Porter, Woodinville, WA (US); Chuming Zhao, Redmond, WA (US); Antonio John Miller, Woodinville, WA (US); Peter Daniel Clyde, Kennewick, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 56 days.

(21) Appl. No.: 16/666,178

(22) Filed: Oct. 28, 2019

Related U.S. Application Data

(60) Provisional application No. 62/854,867, filed on May 30, 2019.

(51) Int. Cl.

| | |
|---|---|
| ***H04R 25/00*** | (2006.01) |
| ***H04R 9/06*** | (2006.01) |
| ***H01F 7/08*** | (2006.01) |
| ***H01F 7/126*** | (2006.01) |
| ***H04R 9/02*** | (2006.01) |
| ***H04R 19/02*** | (2006.01) |

(52) U.S. Cl.
CPC ..... *H04R 9/06* (2013.01); *H01F 7/081* (2013.01); *H01F 7/126* (2013.01); *H04R 9/025* (2013.01); *H04R 19/02* (2013.01); *H04R 2201/003* (2013.01); *H04R 2460/13* (2013.01)

(58) Field of Classification Search
CPC ... H04R 9/04; H04R 9/02; H04R 1/10; H04R 3/00; H04R 9/025; H04R 2209/041; H04R 2209/022; H04R 9/06; H04R 7/24
See application file for complete search history.

(56) References Cited

U.S. PATENT DOCUMENTS 9,130,445 B1 * 9/2015 Katz ..... H02K 41/0356

OTHER PUBLICATIONS

Sun, X. et al., "Parylene-based 3D high performance folded multilayer inductors for wireless power transmission in implanted applications," Sensors and Actuators A: Physical, 2014, vol. 208, pp. 141-151.*

(Continued)

*Primary Examiner* — Amir H Etesam
(74) *Attorney, Agent, or Firm* — Fenwick & West LLP

(57) ABSTRACT

A microelectromechanical system (MEMS) coil assembly is presented herein. In some embodiments, the MEMS coil assembly includes a foldable substrate and a plurality of coil segments. Each coil segment includes a portion of the substrate, two conductors arranged on the portion of the substrate. The substrate can be folded to stack the coil segments on top of each other and to electrically connect first and second conductors of adjacent coil segments. In some other embodiments, the MEMS coil assembly includes a plurality of coil layers stacked onto each other. Each coil layer includes a substrate and a conductor to form a coil. The conductors of adjacent coil layers are connected through a via. The MEMS coil assembly can be arranged between a pair of magnets. An input signal can be applied to the MEMS coil assembly to cause the MEMS coil assembly to move orthogonally relative to the magnets.

19 Claims, 14 Drawing Sheets

(56) References Cited

OTHER PUBLICATIONS

Herrault, F. et al., "Parylene-insulated ultradense microfabricated coils." Journal of Microelectromechanical Systems, 2010, vol. 19, No. 6, pp. 1277-1283.
Iversen, N.E. et al., "Low Impedance Voice Coils for Improved Loudspeaker Efficiency," Audio Engineering Society Convention 139, Audio Engineering Society, 2015, 11 pages.
Reissman, T. et al., "Micro-solenoid electromagnetic power harvesting for vibrating systems," Active and Passive Smart Structures and Integrated Systems, 2008. vol. 6928, International Society for Optics and Photonics, 9 pages.

* cited by examiner

MICROELECTROMECHANICAL SYSTEM COIL ASSEMBLY FOR REPRODUCING AUDIO SIGNALS

CROSS-REFERENCE TO RELATED APPLICATIONS

This application claims the benefit of U.S. Provisional Patent Application No. 62/854,867, filed May 30, 2019, which is incorporated by reference in its entirety.

BACKGROUND

The present disclosure generally relates to electromechanical coils, and specifically to microelectromechanical system (MEMS) coil assemblies for reproducing audio signals.

Many different types of acoustic sources may be used to reproduce music, speech or other audio sources. For example, a typical pair of headphones uses a voice coil and a diaphragm to convert an audio signal into sound waves. The voice coil is usually positioned within a circular gap between the poles of a permanent magnet. When the electrical audio signal is applied to the coil, the coil moves back and forth. The diaphragm is connected to the coil and, as such, moves with the coil. The movement of the diaphragm pushes on the surrounding air to create sound waves that are heard by the wearer of the headphones. This configuration, however, may not be suitable in some driver applications.

As consumer electronics devices become more personal and wearable, internal components are becoming increasingly proximate to each other, which can result in limited space for the components. However, currently available voice coils may not fit in the consumer electronic devices.

SUMMARY

Embodiments of the present disclosure relate to a microelectromechanical system (MEMS) coil assembly. The MEMS coil assembly comprises a substrate and a plurality of coil segments. Each coil segment comprises a portion of the substrate, a first conductor arranged on the portion of the substrate to form a first coil, and a second conductor arranged on the portion of the substrate to form a second coil. The substrate is folded or stacked into the plurality of coil segments on top of each other and electrically connect first conductors and second conductors of adjacent coil segments of the plurality coil segments.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

Embodiments of the present disclosure may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a headset, a head-mounted display (HMD) connected to a host computer system, a standalone HMD, a near-eye display (NED), a mobile device or computing system, or any other hardware platform capable of providing artificial reality content to one or more viewers.

Figure 1A:
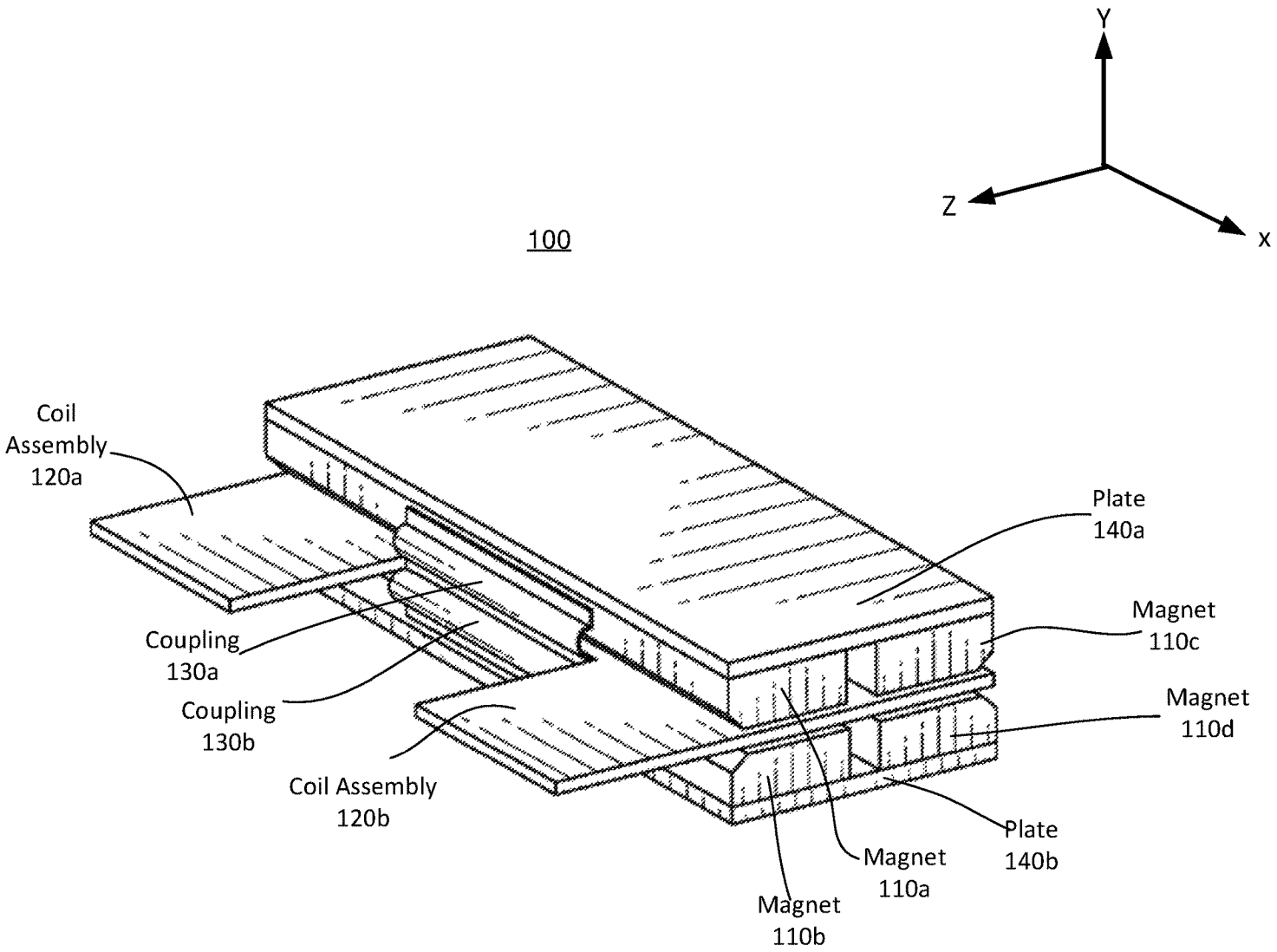
FIG. 1A illustrates a high-efficiency motor for reproducing an audio source, in accordance with one or more embodiments.

FIG. 1A illustrates a high-efficiency motor 100 for reproducing an audio signal, in accordance with one or more embodiments. The high-efficiency motor 100 includes two coil assemblies 120*a* and 120*b* (each also referred to as a coil assembly 120), four magnets 110*a*, 110*b*, 110*c*, and 110*d* (each also referred to as a magnet 110), two suspensions 130*a* and 130*b* (each also referred to as a suspension 130), and two plates 140*a* and 140*b* (each also referred to as a plate 140). In other embodiments, the high-efficiency motor 100 can have different numbers of the components shown or different components. For example, a high-efficiency motor can include one coil assembly 120, one pair of magnets 110, one suspension 130, and two plates 140.

The magnets 110 generate magnetic fields. The four magnets 110 form two pairs of magnets 110: a pair including the magnets 110A and 110*b*, and the other pair including the magnets 110*c* and 110*d*. Each pair of magnets 110 has an aligned polarity. In some embodiments, the magnets 110*a* and 110*b* are each arranged with the south pole over the north pole (S/N). The north pole of magnet 110*a* and the south pole of magnet 110*b* face each other in the corresponding aligned polarity. The magnets 110*c* and 120D can be arranged in the opposite fashion, with the north pole over the south pole (N/S). The south pole of magnet 110*c* and the north pole of magnet 110*d* face each other in the corresponding aligned polarity.

In the embodiment of FIG. 1A, the high-efficiency motor 100 includes two pairs of magnets 110. In other embodiments, the high-efficiency motor 100 includes one pair of magnets 110, or three or more pairs of magnets 110. Any or all of the four magnets 110 may be permanent magnets. The magnets 110 may be various sizes, and each magnet may be the same size, or different magnets may be different size. Similarly, the magnets 110 may include rectangular cross sections as shown in FIG. 1A, or may include other types of cross sectional shapes such as square or circular shapes. In one embodiment, the magnets 110 are relatively long and wide to increase the amount of magnetic face over (and beneath) the coil assemblies 120.

The coil assemblies 120 are arranged between the magnets 110 and can move relative to the magnets 110, e.g., on a plane that is orthogonal to the magnets 110. Each coil assembly 120 includes one or more coils. Each coil includes at least one conductor and an insulator. The conductor can be a metal (such as Al, Au, Ag, Be, Cu, etc.) and deposited onto the insulator. The conductor can be of various shapes, such as race track, round, circle, oval, rectangular, spiral, serpentine, etc. An electrical audio signal (e.g., electrical current) can be applied to the conductive coil. Due to the Lorentz force principle, when electrical current flows through the coils and passes the magnetic fields generated by the magnets 110, an orthogonal Lorentz force is created. The Lorentz forces drives the coil assemblies 120 to move orthogonally relative to the magnets 120. The movement of the coil assemblies 120 may vibrate the pinna (or other part) of a user's ear. The vibrations are generated according to the electrical audio signal, thereby reproducing the audio content of the audio signal (e.g., words, music or other sounds) for the user.

The coil assembly 120 are linked to the magnets 110 in a flexible manner via the suspensions 130. The suspensions 130 allow the coil assemblies 120 some freedom of movement, while still holding the coil assemblies relatively in place. In some embodiments, the suspensions 130 allow the coil assembly 120 to move when pushed by the Lorentz force and then return (via spring force) to a neutral position after the Lorentz force is no longer active. Accordingly, as the Lorentz forces are periodically applied to the coil assembly 120 at a certain frequency, the coil assembly 120 will vibrate at that frequency. The mechanical movement of the coil assembly 120 thus acts as a driver that vibrates the user's ear. When the input signal varies the frequency, the moving coil assembly will vibrate at the varied frequency, thereby recreating the audio signal in the user's ear, using the user's ear as the acoustic radiator.

In some embodiments, the coil assemblies 120 includes two or more conductors to maximize packing factor, i.e., a ratio of the volume of the conductor of the coil assembly 120 to the total volume of the coil assembly 120 within the concentrated magnetic field. The total volume of the coil assembly 120 includes volume of the conductor plus any non-conductor material, typically the insulation layers and adhesive layers. In one embodiment, a second conductor is deposited or electroplated between the spaces defined by a first conductor. The packing factor of each coil assembly 120 is above 30%. In some embodiments, the packing factor can be 70%, or even 90% or above.

One or both of the coil assemblies 120 can be a MEMS coil assembly that includes coils manufactured with MEMS fabrication techniques. Some examples of MEMS fabrication techniques may include lithography, chemical vapor deposition (CVD), electrodeposition or electroplating, epitaxy, thermal oxidation, physical vapor deposition (PVD), evaporation, sputtering, or casting. In one example, the MEMS coil assembly includes a plurality of coil segments that can be stacked on top of each other. Each coil segment includes a conductor arranged on an insulator to form a coil. In some embodiments, the insulator is a portion of a foldable substrate. The substrate can be folded to form a stack of the coil segments, where the conductors of the coil segments are electrically connected. In some other embodiments, the coil segments are layered on top of each other. The conductors of the coil segments are electrically connected through vias that extend through the insulator of each coil segment from a side including the conductor to another other side of the insulator. The vias allow electrical connection points to be on the same end or both ends of the coil assembly 120, even with odd numbers of coil layers having radial conductors.

MEMS fabrication techniques have advantages like high precision and high scalability. Traces of conductors of the coils can be precisely defined using MEMS techniques to achieve a good control over coil temperature, coil mass, and force factor (BL) definition, which can improve active control methods. The thickness of the insulator of a coil can also be precisely defined to produce an ultra-thin insulator. With the ultra-thin insulator, the coils can have high packing factor. Also, the additive MEMS fabrication nature allows the MEMS coils to overcome the design and manufacturing constraint of traditional wound coils to enable some sharp bending angles and high aspect ratio coil shapes. These coil designs are sometimes useful but difficult to manufacture from traditional wound coils techniques, because the wound coil would spring back to its original configuration. Because of these advantages, the MEMS coil can enable efficient and non-conventional electromagnetic motor designs. Also, the cost of manufacturing the coils can be reduced by using MEMS fabrication technologies, e.g., during mass production.

One or both of the coil assemblies 120 can be a PCB coil assembly. A PCB coil assembly includes a PCB and coil layers arranged in the PCB. The coil layers are stacked on top of each other. Each coil layer includes a substrate and one or two conductors arranged on the substrate to form a coil. The conductors of the coil layers are electrically connected through one or more vias that extend through the substrates of the coil layers.

In some embodiments, each coil assembly 120 includes a rigid structure that facilitates movement of the coil assembly 120. The rigid structure can vibrate according to frequencies designated in an input signal. In an embodiment where the coil assembly 120 is a PCB coil assembly, the rigid structure is the PCB. In other embodiments, the rigid structure may be other structures that are sufficiently rigid to receive forces applied to the coil assembly 120.

The plates 140 are affixed to the magnets 110 and work as a mounting mechanism and magnetic flux return paths for magnets 110. In some embodiments, the plates 140 has high permeability. The plates 140 may be made of steel or other structurally solid material with sufficient magnetic permeability and a sufficiently high magnetic induction saturation value. The steel plates may include fasteners for the magnets which hold the magnets in place relative to each other. When an input signal is applied to the coil assemblies 120 sandwiched between the magnets 110, the coil assemblies 120 may begin to move. In some embodiments, the plates 140 holds the magnets 110 in a way that the Lorentz force generated can cause motive forces of opposite directions and equal values applied on the coil assemblies 120 and magnets 110 so that the coil assemblies 120 and magnets 110 move relative to each other. The input signal may cause motive force to be applied in the frequencies specified in the input signal. As such, the coil assembly may move relative to the magnets 110 as driven by the input signal. In some embodiments, the magnets 110 and the plates 140 are one piece. The plates 140 may be soft-magnet plates that exhibit a relatively low level of magnetic coercivity.

Figure 1B:
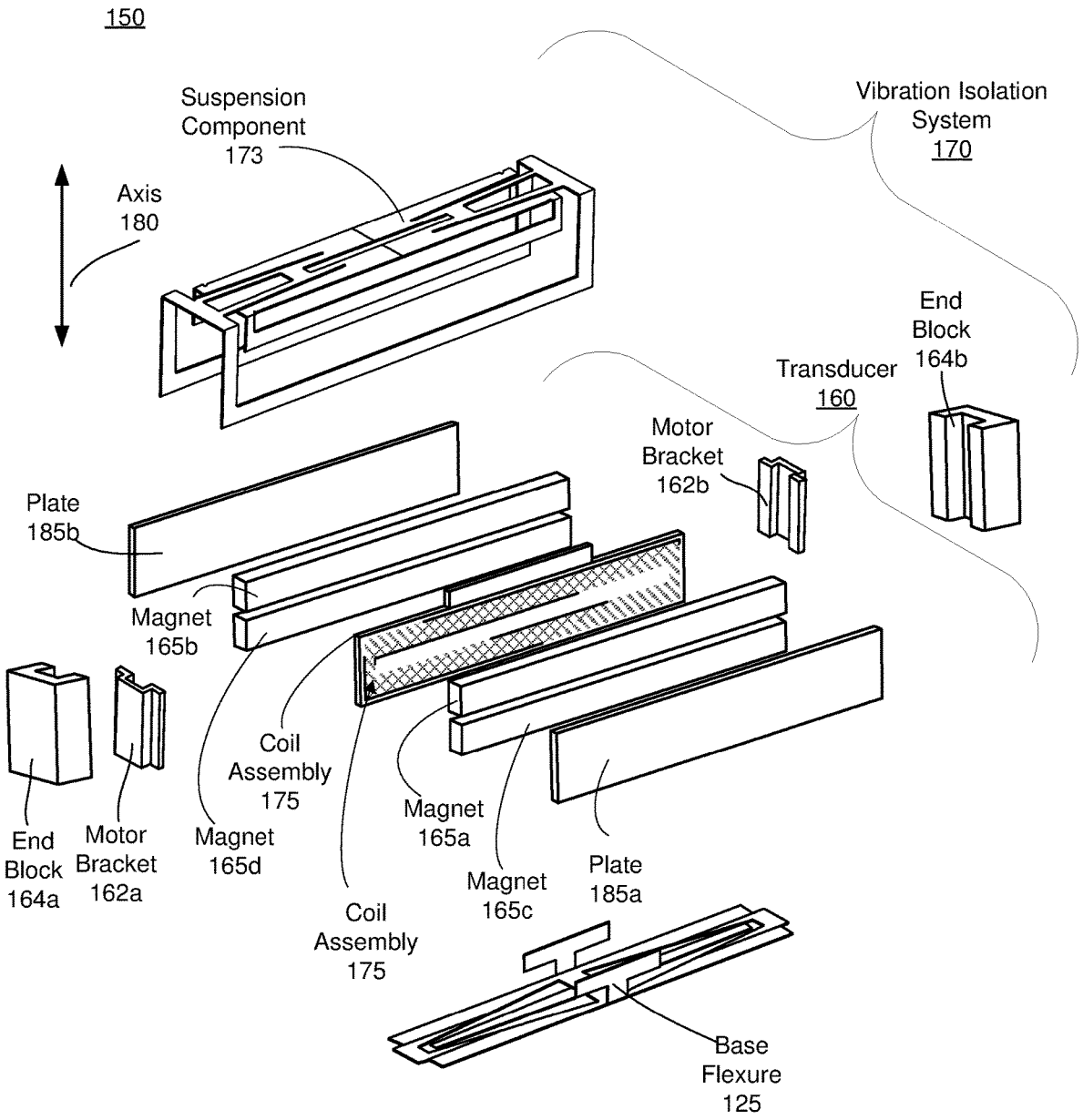
FIG. 1B illustrates a transducer system including a transducer and a vibration isolation system, in accordance with one or more embodiments.

FIG. 1B illustrates a transducer system 150 including a transducer 160 and a vibration isolation system 170, in accordance with one or more embodiments. The transducer system 150 can be coupled to a device, such as an eyewear device of an artificial reality system, to provide audio content to a user of the device. In some embodiments, the transducer system 150 is substantially symmetric with respect to an axis that is orthogonal to an axis 180.

The transducer 160 is an electromagnetic motor that converts electrical energy and magnetic energy to mechanical energy. An embodiment of the transducer is the high-efficiency motor 100 described in conjunction with FIG. 1A. The transducer 160 produces vibrations, e.g., as it actuates to provide audio content to the user of the device. The transducer 160 includes four magnets 165*a*, 165*b*, 165*c*, and 165 (each referred to as a magnet 165), a coil assembly 175, plates 185*a* and 185*b* (each referred to as a plate 185), and motor brackets 162*a* and 162*b* (each referred to as a motor bracket 162). The coil assembly 175 can move in relative to the magnets 165, e.g., along the axis 180. The motor brackets bind the magnets 165 and plates 185 together.

The vibration isolation system 170 isolates vibrations produced by the transducer 160 from the device. The vibration isolation system 170 includes a suspension component 173, two end blocks 164*a* and 164*b* (each referred to as a end block 164), and a base flexure 183.

The suspension component 173 is formed from a single monolithic piece of material that has been cut and shaped to form a single suspension component. The material may be, e.g., aluminum, brass, copper, steel, nickel, titanium, a shape memory alloy (e.g., nitinol), alloys, other suitable types of materials, or some combination thereof. The suspension component 173 may be connected to and/or coupled to the end blocks 164 via adhesive, screws, welds, mechanical means, etc. In some embodiments where a shape memory alloy is used to form some or all of the vibration isolation system 170, the shape memory alloy would be such that its superelastic properties would be used. Superelasticity can help mitigate breakage and/or strain caused by long term cycling components (e.g., flexures) of the vibration isolation system 170.

The suspension component 173 include three sets of flexures that couple to the transducer 160 within the vibration isolation system 170. The first set of flexures suspends the coil assembly 175 from the end blocks 164. The second set of flexures suspends the magnets 165 from the coil assembly 175. As illustrated in FIG. 1B, the coil assembly 175 is coupled to the suspension component 173, but is not coupled to the magnets 165. The third set of flexures suspends the magnets 165 from the end blocks 164. Some or all of the suspension component 173 may be formed from, e.g., aluminum, brass, copper, steel, nickel, titanium, a shape memory alloy (e.g., nitinol), alloys, other suitable types of materials, or some combination thereof. Super elasticity can help mitigate breakage and/or strain caused by long term cycling components (e.g., flexures) of the vibration isolation system 170 or from deformations outside normal operation limits due to the mechanical output faces being exposed to direct user contact.

The end blocks 164 couple the transducer 160 to the suspension component 173 and provides mechanical attachment for the transducer 160. The end blocks 164 are positioned at or near an end of the vibration isolation system 170. The end blocks 164 are columns that are substantially centered on respective short sides of the transducer 160.

In one embodiment, the end blocks 164 may be hollow and designed to receive a screw that secures a base of each end block 164 to the device. In one embodiment, some portion of one or both end blocks 164 includes an adhesive surface. In alternate embodiments, the shape and dimensions of each end block 164 may vary. For example, a end block 164 may have a planar, polygonal, or other suitable shape.

The base flexure 183 suspend plates 185*a*, 185*b* of the transducer 160 from the end blocks 164. In some embodiments, the base flexure 183 is formed from a single monolithic piece of material that has been cut and shaped to function as the base flexure 183. In other embodiments, some or all of the base flexure 183 is formed of discrete pieces that have are coupled together. Some or all of the base flexure 183 may be formed from, e.g., aluminum, brass, copper, steel, nickel, titanium, a shape memory alloy (e.g., nitinol), alloys, plastics, other suitable types of materials, or some combination thereof.

Some portion of the transducer system 150 may be used to drive a membrane of a speaker and/or provide audio content via tissue conduction (e.g., bone conduction and/or cartilage conduction). For example, a portion of the coil assembly 175 that is projecting above the suspension component 173 may be used to provide vibration to a membrane for air conduction, or a material that couples vibrations to the user (e.g., for tissue conduction).

Figure 2A:
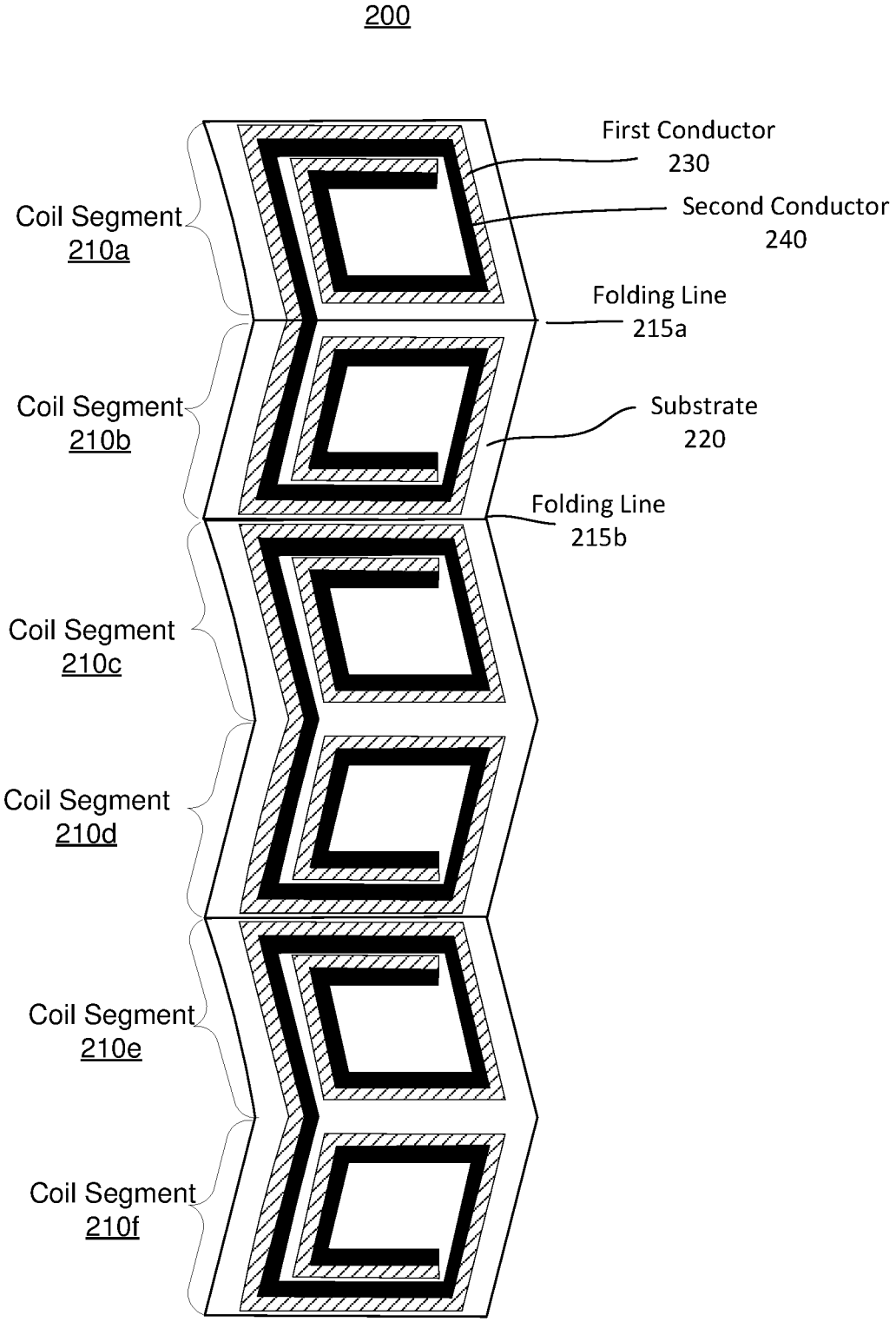
FIG. 2A illustrates a MEMS coil assembly including coil segments folded onto each other, in accordance with one or more embodiments.

FIG. 2A illustrates a MEMS coil assembly 200 including coil segments 210*a* through 210*f* folded onto each other, in accordance with one or more embodiments. The MEMS coil assembly 200 includes six coil segments 210*a*, 210*b*, 210*c*, 210*d*, 210*e*, and 210*f* (each referred to as a coil segment 210) and a substrate 220 shared by the coil segments 210*a-f*. In some other embodiments, the MEMS coil assembly 200 can include less or more than six coil segments 210. In some embodiments, the MEMS coil assembly 100 has a length in a range from 20 mm to 25 mm and a width in a range from 3 mm to 8 mm.

Each coil segment 210 includes a portion of the substrate 220, a first conductor 230 arranged on the portion of the substrate 220 to form a first coil, and a second conductor 240 arranged on the portion of the substrate 220 to form a second coil. The first conductor 230 and second conductor 240 can include gold, nickel, copper, silver, aluminum or beryllium, alloy, or some combination thereof, and may be formed on the substrate 220 via deposition or electroplating. With the first conductor 230 and second conductor 240, each coil segment 210 has a packing factor equal to or above 90% and the MEMS coil assembly 200 has an overall packing factor equal to or above 90%.

The high packing factor results in high efficacy. Under the Lorentz force principle, the Lorentz force is determined using the following equation:

$$F=q(E+v\times B) \quad (1)$$

where F is Lorentz force, q is amount of electrical charge, E is electrical field strength, v is instantaneous velocity, B is magnetic field strength. With a higher ratio of the volume of the conductors to the total volume of the coil assembly 210, q is larger, resulting in stronger Lorentz force F. With the stronger Lorentz force, movement of the coil assembly 210 is enhanced.

There is a gap between the first conductor 230 and second conductor 240 of each coil segment. The gap may have a width in a range from 35 μm to 500 μm. In some embodiments, a coil segment 210 may include more than two conductors.

In some embodiments, each coil segment 210 also includes a coating between the portion of the substrate and the conductors. The coating mitigates heat generated from operation of the MEMS coil assembly to avoid melting or degradation of the substrate. In some embodiments, the coating may be a layer of Alumina.

A coil segment 210 can be fabricated through layer-by-layer deposition. For example, the first conductor 230 and second conductor 240 of a coil segment 210 can be deposited onto the corresponding portion of the substrate 220 through physical vapor deposition, or some other MEMS fabrication technique.

Traces of the first conductor 230 and second conductor 240 can be precisely defined using MEMS fabrication techniques. In some embodiments, the width dimensions of the first conductor 230 and second conductor 240 of each coil segment 210 have a precision of less than 1 μm.

The substrate 220 includes six portions that can be folded onto each other, such as along folding lines 215*a* or 215*b*. The substrate is electrically insulative. In some embodiments, the substrate may be made of parylene or polyimide. A parylene substrate can be made by evaporating and concormally coating parylene on a base in vacuum. In atmosphere, parylene oxidizes at approximately 100° C., and melts at 290° C. Adhesion promoter may be needed before evaporating parylene to improve adhesion. A polyimide substrate can be made by spin coating or spray coating polyimide on a base.

After the substrate 220 is folded, the coil segments 210 are stacked on top of each other. Also, first conductors and second conductors of adjacent coil segments are electrically connected. The coil segment 210*a* is stacked on top of the coil segment 210*b* with the substrate portion of the coil segment 210*a* contacting with the substrate portion of the coil segment 210*b*. But because the first conductor 230 of the coil segment 210*a* connects with the first conductor 230 of the coil segment 210*b* and the second conductor 240 of the coil segment 210*a* connects with the second conductor 240 of the coil segment 210*b*, the coil segments 210*a* and 210*b* are electrically connect with each other. The coil segment 210*b* is stacked on top of the coil segment 210*c* with the first conductor 230 and second conductor 240 of the coil segment 210*b* contacting with the first conductor 230 and second conductor 240 of the coil segment 210*c*, so that the coil segments 210*c* is electrically connected to the coil segments 210*a* and 210*b*. Similarly, all the six coil segments 210 are electrically connected.

Improved resistance, inductance and capacitance are achieved by folding the coil segments 210. In some embodiments, the MEMS coil assembly 200 has an impedance in a range from 1Ω to 350Ω. The MEMS coil assembly can have an inductance in a range from 10 μH to 100 μH.

Figure 2B:
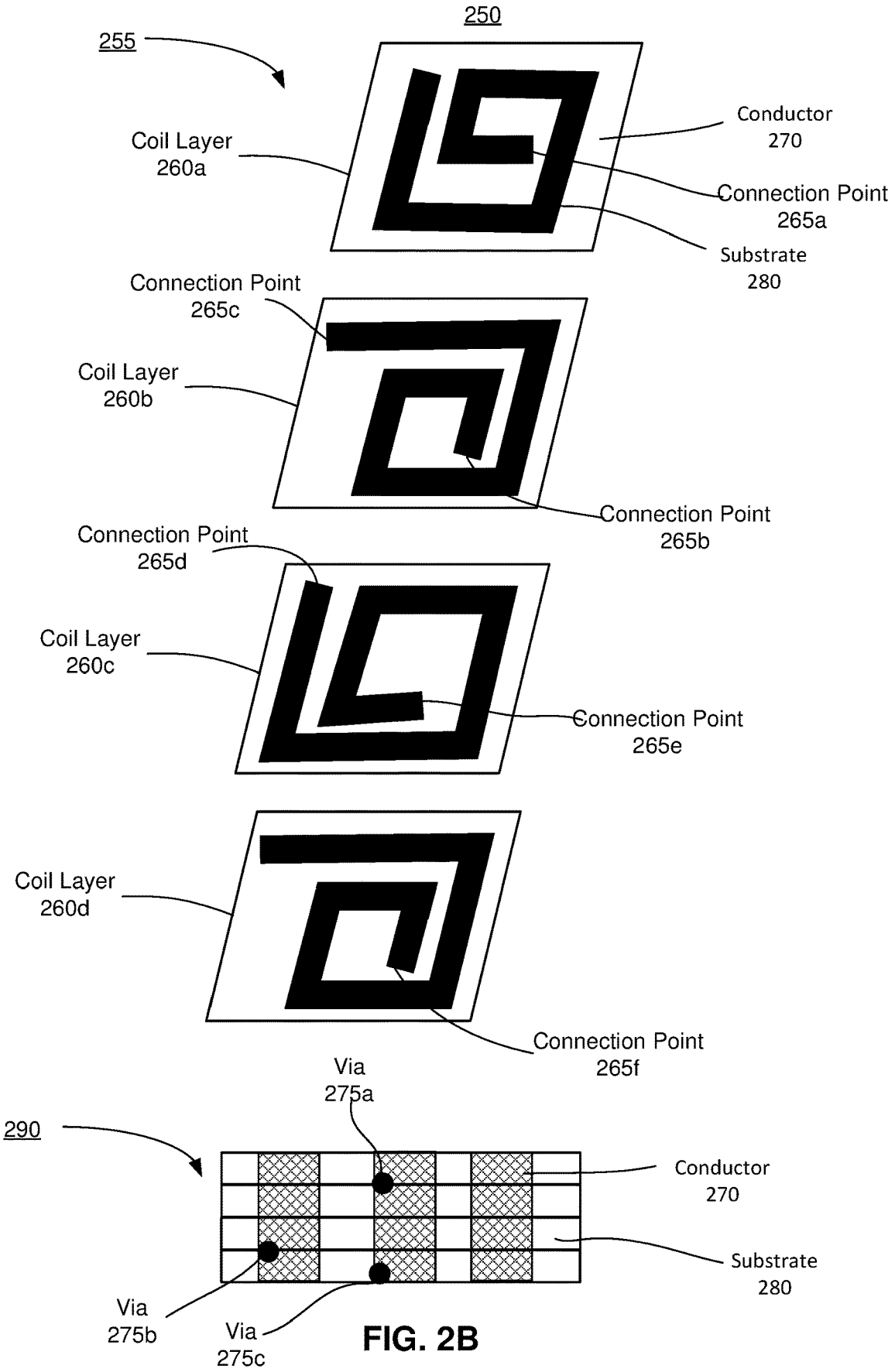
FIG. 2B illustrates a MEMS coil assembly including coil layers stacked onto each other, in accordance with an embodiment.

FIG. 2B illustrates a MEMS coil assembly 250 including coil layers 260*a* through 260*d* stacked onto each other, in accordance with an embodiment. FIG. 2B shows an exploded view 255 and a side view 290 of the MEMS coil assembly 250.

Each coil layer 260 includes a substrate 280 and a conductor 270. In some embodiments, the substrate is an insulator comprising parylene and/or polyimide. An embodiment of the substrate 280 has a same material as the substrate 220 in FIG. 2A. The conductor 270 is arranged on the substrate 280 to form a coil. The conductor 270 can include gold, nickel, copper, silver, aluminum or beryllium, alloy, or some combination thereof, and may be formed on the substrate 280 via deposition or electroplating. In some embodiments, each coil layer 260 includes multiple conductors to form multiple coils. As shown in FIG. 2B, the conductor 270 of each coil layer 260 has a "race track" shape. In other embodiments, the conductor 270 can have other shapes, such as round, circle, oval, rectangular, spiral, serpentine, etc.

The conductors 270 of the coil layers 260 are electrically connected through vias 275*a* through 275*c*. Each via 275 connects connection points 265 of the conductors 270 of adjacent coil layers 260. The via 275*a* connects the connection point 265*a* of the coil layer 260*a* and the connection point 265*b* of the coil layer 260*b*. The via 275*b* connects the connection point 265*c* of the coil layer 260*b* and the connection point 265*d* of the coil layer 260*c*. The via 275*c* connects the connection point 265*e* of the coil layer 260*c* and the connection point 265*f* of the coil layer 260*d*. The embodiment of FIG. 2B includes three vias 275. In some other embodiments, there can be a different number of vias. Each via 275 extends through the substrate 280 of the corresponding coil layer 260 from a side including the conductor 270 to another other side of the substrate 280. These vias 275 allow electrical connection points to be on the same end or both ends of the coil, even with odd numbers of coil layers 260. The MEMS coil assembly 250 can accommodate high aspect ratio winds.

For each coil layer 260 of the MEMS coil assembly 250, a coating can be added between the conductor 270 and substrate 280 to mitigate heat generated during operation of the MEMS coil assembly 250. so that melting or degradation of the substrate 280 can be avoided. For instance, a layer of Alumina may be added between the conductor 270 and substrate 280.

Figure 3:
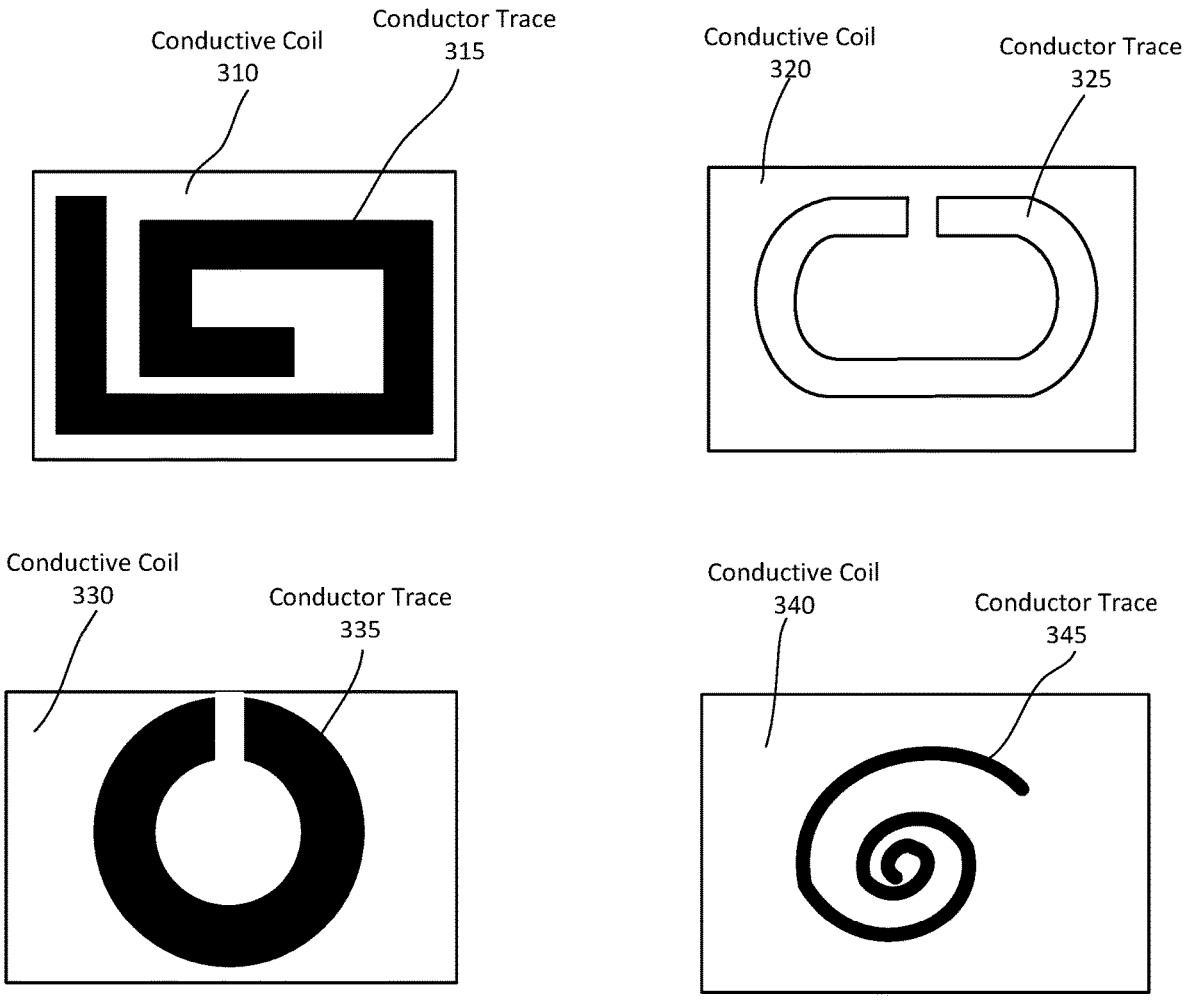
FIG. 3 illustrates conductor traces having different shapes, in accordance with one or more embodiments.

FIG. 3 illustrates conductor traces 315, 325, 335, and 345 having different patterns, in accordance with one or more embodiments. FIG. 3 shows four coils 310, 320, 330, and 340. Each coil has a conductor arranged on a substrate. Traces of the conductors 315, 325, 335, and 345 have different shapes. The conductor trace 315 has a shape of a race track. The conductor trace 325 has an oval shape. The conductor trace 335 has a round shape. The conductor trace 345 has a spiral shape. Even though not shown in FIG. 3, conductor traces can have other shapes, such circle, rectangular, serpentine, etc.

Figure 4:
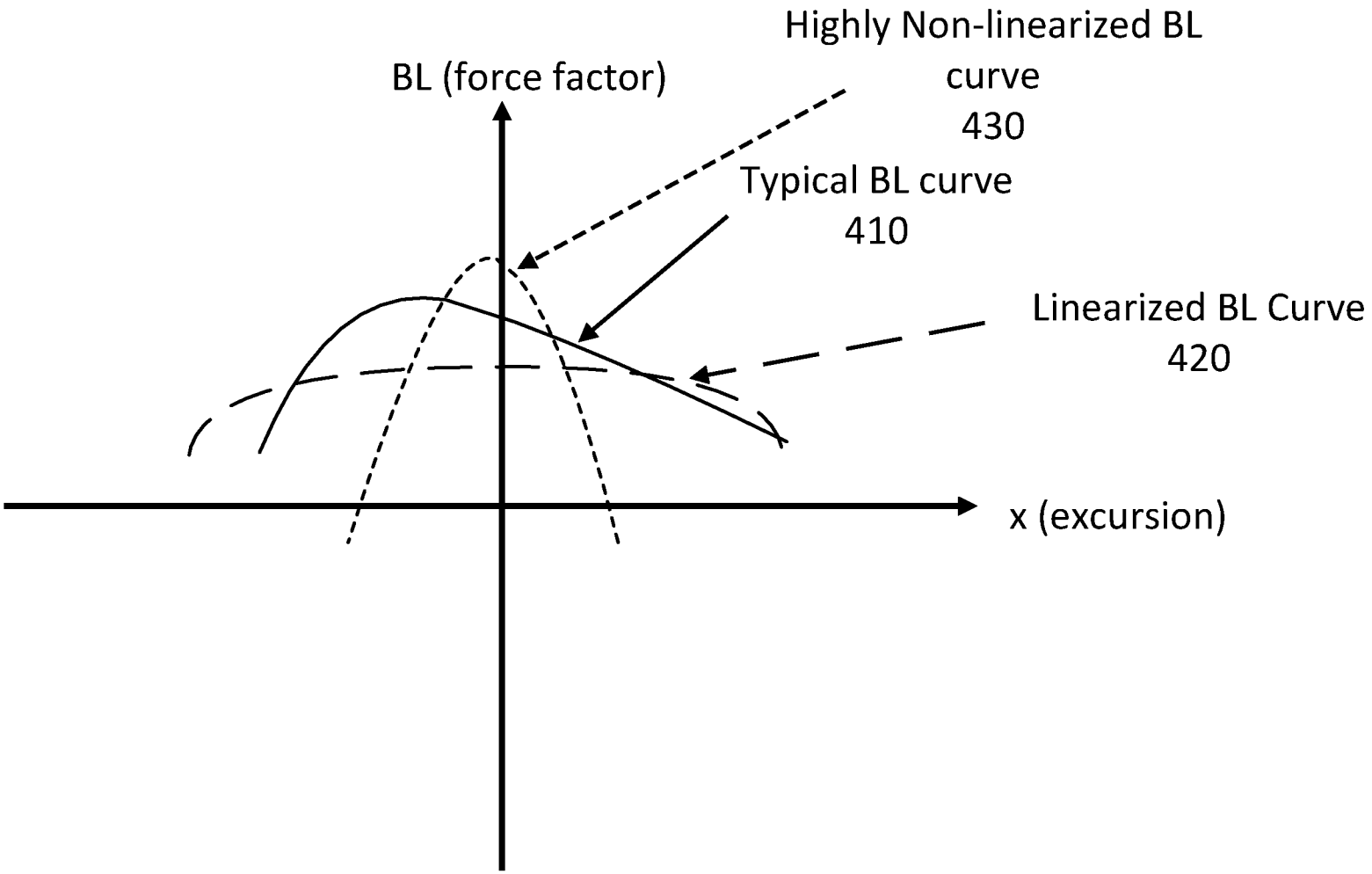
FIG. 4 illustrates force factor curves optimized by MEMS techniques, in accordance with one embodiment.

FIG. 4 illustrates force factor curves optimized by MEMS techniques, in accordance with one embodiment. MEMS techniques can precisely control patterns and dimensions of conductor traces to achieve a good control over force factor (BL) definition. FIG. 4 shows a typical BL curve 410 for miniaturized motors, a linearized BL curve 420, and a highly non-linearized BL curve 430.

The typical BL curve 410 shows force factor of a conventional miniaturized electromagnetic motor as a function of excursion. As shown in FIG. 4, the typical BL curve 410 has uneven distribution over the excursion range. That can cause uneven distribution of Lorenz forces applied on the coil, producing distorted audio content and offsetting of the coil's operating point.

The linearized BL curve 420 and highly non-linearized BL curve 430 are achieved using careful pattern design and MEMS fabrication with high precision. The linearized BL curve 420 and highly non-linearized BL curve 430 have advantages over the typical BL curve 410.

The linearized BL curve 420 has a nearly constant value over most of the excursion range and therefore, is preferred to obtain low distortion for clean audio. In some embodiments, an algorithm may be used to determine voltage and current to compensate for the BL shape. Pre-distorted voltage and/or current may be used to linearize the output of a motor with a moderately or highly non-linear BL curve.

The highly non-linear BL curve 430 does not have a flat distribution, but has a higher BL value near x=0 compared with the typical BL curve 410. Therefore, the highly non-lineared BL curve 430 is preferred to obtain high efficiency near x=0.

Figure 5:
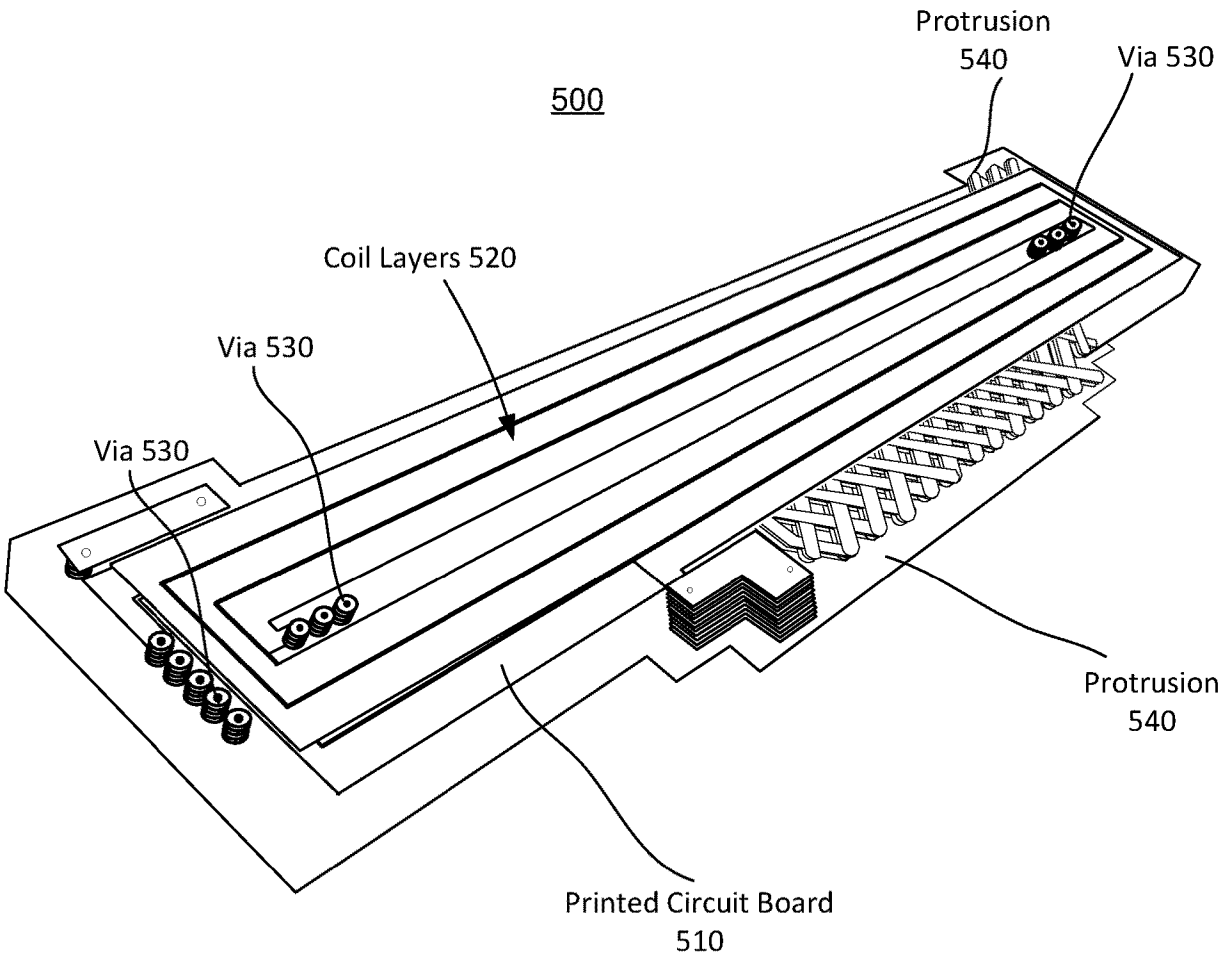
FIG. 5 illustrates a perspective view of a PCB coil assembly, in accordance with one or more embodiments.

FIG. 5 illustrates a perspective view of a PCB coil assembly 500, in accordance with one or more embodiments. The PCB coil assembly 500 includes a printed circuit board (PCB) 510, coil layers 520 arranged in the PCB, vias 530, and protrusions 540 arranged on the PCB 510. In some embodiments, the PCB coil assembly 500 has a thickness in a range from 100 μm to 1000 μm.

The PCB 510 mechanically supports the coil layers 520. For example, the PCB 510 maintains tight flatness tolerances and straight traces for the coil layers 520, which are problematic in high aspect ratio coils made with winding processes. In some embodiments, the PCB 510 can be thin with a high aspect (e.g., 3:1 or above) footprint. The total thickness of the PCB 510 can be approximately 100-1000 μm. The PCB 510 may have a rigid structure that can move in response to a force applied on the PCB 510. The PCB 510 can also electrically support the coil layers 520. For instance, the PCB 510 provides electrical connections for applying electrical signals to the coil layers 520.

The coil layers 520 are arranged in a coil region in the PCB 510. Each coil layer 520 includes a substrate and a conductor arranged on the substrate to form a coil. In some embodiments, the coil layers (with edge clearances) can fit within a 4.15 mm×22.6 mm footprint. Each coil layer 520 may also include a layer of alumina between the substrate and the conductor. The layer of alumina mitigates heat generated from operation of the PCB coil assembly 500.

Dimensions of the coils and traces can be scaled to desired impedance. In some embodiments, the total length of the conductor traces of the coil layers 520 can be 10 m or higher. The impedance of the coil layers 520 can be in a range from 1Ω to 350Ω.

Traces of the conductors can be designed to achieve desired packing factor. The conductor traces can be in various shapes, such as race track, round, circle, oval, rectangular, spiral, serpentine, etc. In some embodiments, the packing factor of the PCB coil assembly 500 can be above 70%. To achieve a higher packing factor, each coil layer 520 can include a second conductor on the substrate arranged in a second coil. A gap between the coil and the second coil can be in a range from 1 μm to 50 μm. More details of the coil layers 520 are described below in conjunction with FIGS. 6A-F.

The vias 530 electrically connect the conductors of two or more coil layers 520. In some embodiments, each via 530 electrically connects two adjacent coil layers 520. In some embodiments, the vias 530 extend through the substrate of each coil layer 520, e.g., the vias 530 extend from a side of the substrate where the conductor is arranged to the opposing side of the insulator.

The protrusions 540 provide mechanical and electrical connections of the PCB 510. The protrusions can be glued and/or electrically connected to mechanical attachment points, such as metal springs. Furthermore, copper cross-hatching may be used to mechanically stiffen the protrusion while avoiding the mass penalty that would be incurred by completely filling the portions of the PCB 500 corresponding to the protrusions 540 with copper.

Figure 6A:
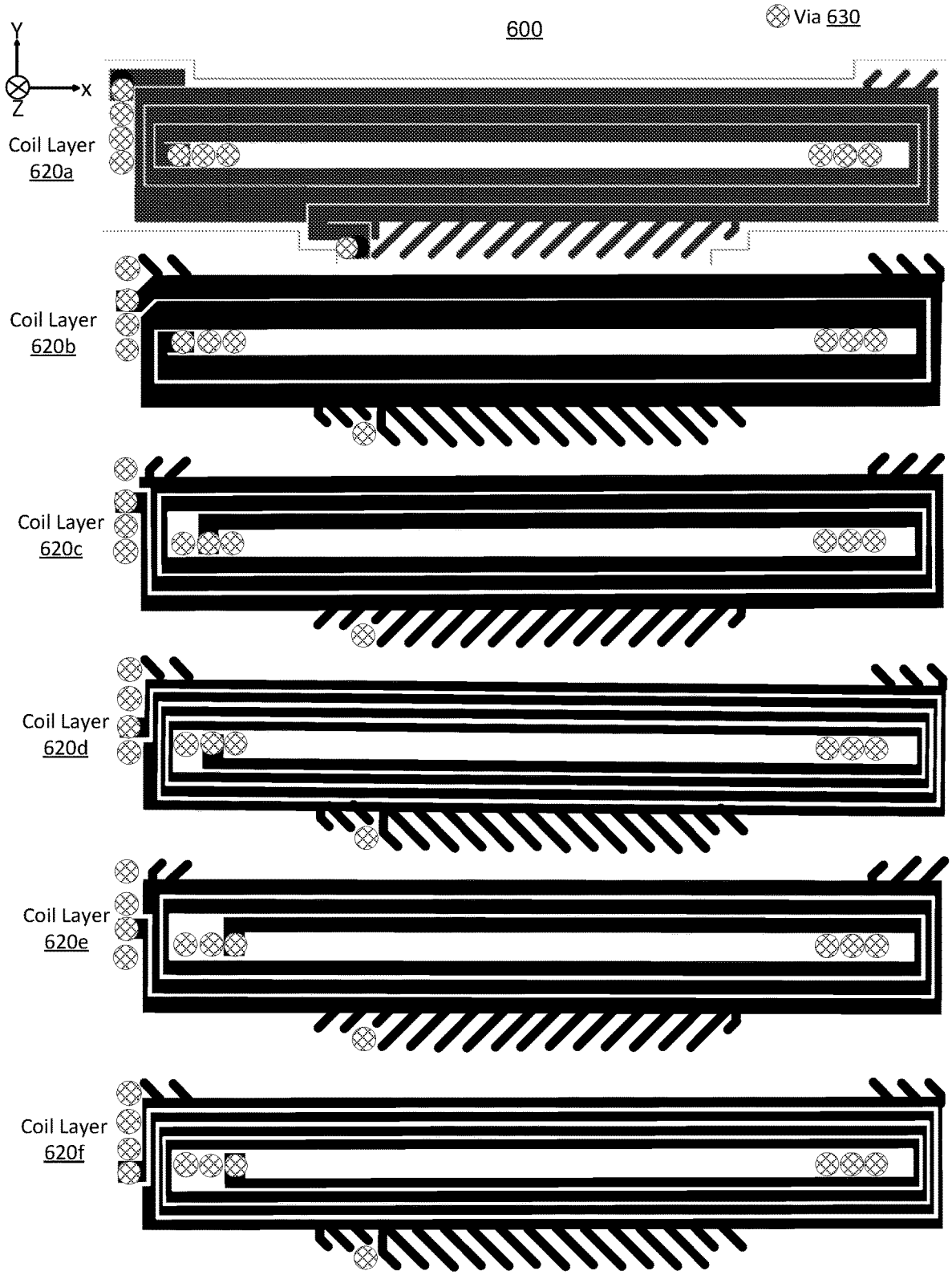
FIGS. 6A and 6B each illustrate coil layers of a PCB coil assembly, in accordance with one or more embodiments.

FIG. 6A illustrates coil layers 620 of a PCB coil assembly 600, in accordance with one or more embodiments. The PCB coil assembly 600 can be an embodiment of the PCB coil assembly 500. FIG. 6A shows six coil layers 620*a-f*. In other embodiments, the PCB coil assembly 600 can include less or more than the six coil layers 620*a-f*. In FIG. 6A, conductor traces of the coil layers 620 are in a race track shape. In other embodiments, the conductor traces can be in other shapes.

The coil layers 620*a-f* are electrically connected through vias 630. Also, the vias 630 can provide electrical connection between the coil layers 620*a-f* and a signal source that provides audio input signals (such as electrical current) to the coil layers 620*a-f*.

The coils of the coil layers 620*a-f* have different winding patterns. The coils of the coil layers 620*a*, 620*c*, and 620*e* have a three-wind pattern, while the coil of the coil layer 620*b* has a two-wind pattern, and the coil of the coil layer 620*e* has a four-wind pattern. With the different winding patterns, the coils correspond to different portions of the coil layers 620 such that mechanically weak points in the PCB coil assembly 600 can be reduced or even eliminated. Such a design can also promote heat mitigation between the coil layers 620. Patterns of the coils are designed to maximize length of the conductors along an X axis, e.g., to maximize Lorenze force in directions along an Y axis or Z axis. More details regarding patterns of the coils are described below in conjunction with FIG. 7. In some embodiments, terminals of the coil of the coil layers 620*a-f* can be routed to different locations on the PCB coil assembly 600.

Figure 6B:
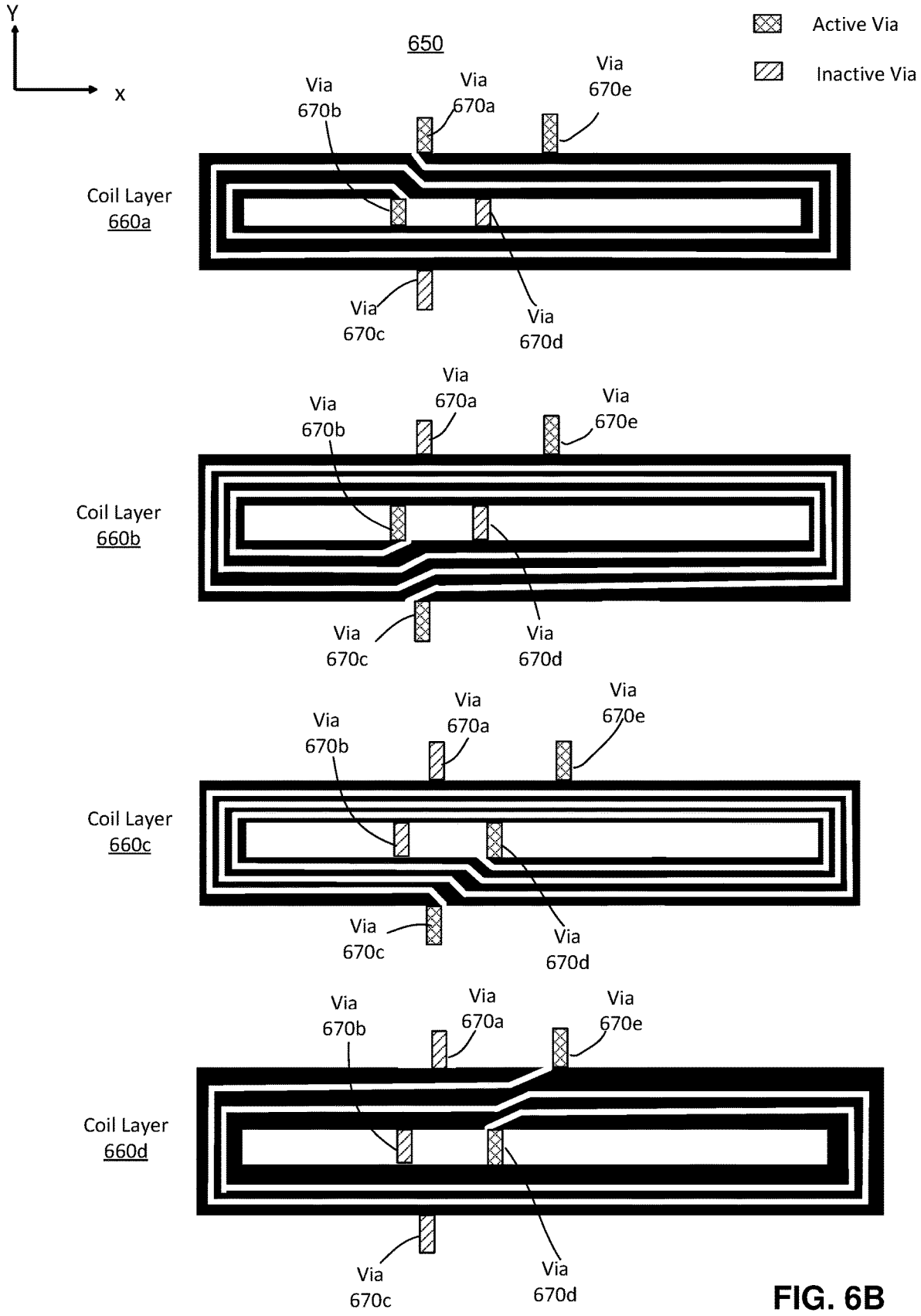

FIG. 6B illustrates coil layers 660 of a PCB coil assembly 650, in accordance with one or more embodiments. The PCB coil assembly 650 can be an embodiment of the PCB coil assembly 500. The PCB coil assembly 650 includes four coil layers 660*a-d* and five vias 670. In other embodiments, the PCB coil assembly 650 can include less or more than the four coil layers 660*a-d* and less or more than the five vias 670*a-e*.

The coils of the coil layers 620*a-f* have different winding patterns. The coils of the coil layers 660*a* and 660*d* each have a three-wind pattern, while the coils of the coil layer 660*b* and the coil layer 660*c* each have a four-wind pattern. The different winding patterns avoids mechanically weak points in the PCB coil assembly 650 and can also promote heat mitigation between the coil layers 660.

The vias 670 provides electrical connection among the coils of the coils layers 660*a-d* as well as electrical connection between the coils and a signal source that provides audio input signals (such as electrical current) to the coil layers 660. Each via 670 is either active or inactive in each coil layer 660. An active via provides electrical connection between the corresponding coil layer 660 and an adjacent coil layer 660 or the signal source. An inactive via is not connected to the coil of the corresponding coil layer, but the inactive via may have an electric potential. Positions of the vias 670 are selected to maintain balance of the coils and avoid rocking of the PCB coil assembly 650.

In the coil layer 660*a*, the vias 670*a* are 670*b* are active and the other vias 670*c-e* are inactive. The via 670*a* electrically connects the coil layer 660*a* to the signal source (such as the positive terminal of the signal source), and the via 670*b* electrically connects the coil layer 660*a* to the coil layer 660*b*. In the coil layer 660*b*, the vias 670*b* and 670*c* are active and the other vias 670 are inactive. The via 670*b* electrically connects the coil layer 660*b* to the coil layer 660*a*. The via 670*c* electrically connects the coil layer 660*b* to the coil layer 660*c*. In the coil layer 660*c*, the vias 670*c* and 670*d* are active. The via 670*c* electrically connects the coil layer 660*c* to the coil layer 660*b*. The via 670*d* electrically connects the coil layer 660*c* to the coil layer 660*d*. In the coil layer 660*d*, the vias 670*d* and 670*e* are active. The via 670*d* electrically connects the coil layer 660*d* to the coil layer 660*c*. The via 670*e* electrically connects the coil layer 660*d* to the signal source (such as the negative terminal of the signal source). As shown in FIG. 6B, the vias 660*a* and 660*d* are on the same side of the PCB coil assembly 650 along the Y axis.

The arrangement of the vias 660 in the PCB coil assembly 650 are advantageous. First, because the vias 660*a* and 660*d* are on the same side, it is convenient to build electrical connection between the coil layers 660 and the signal source. Second, the vias 660 are all arranged on portions of the coils along the X direction and therefore, the vias 660 do not take space along the X axis. Compared with the PCB assembly 600 in FIG. 6A, the length of the coils along the X axis can be further maximized.

Figure 7:
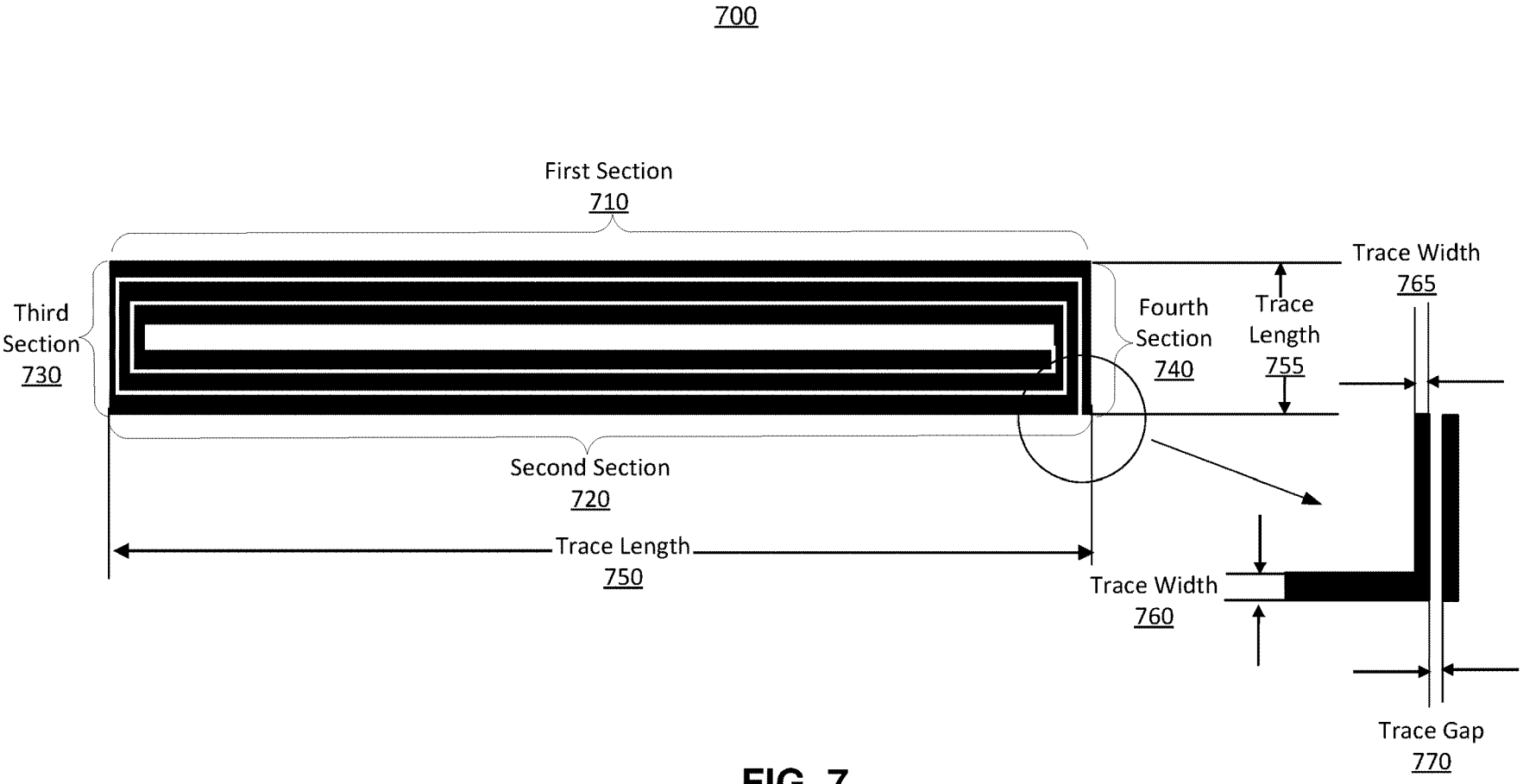
FIG. 7 illustrates winding pattern of a coil of the PCB coil assembly, in accordance with one or more embodiments.

FIG. 7 illustrates winding pattern of a coil 700 of the PCB coil assembly 500, in accordance with one or more embodiments. The coil 700 includes four sections: a first section 710 and a second section 720 (i.e., main sections 710 and 720) that extend along an X axis, and a third section 730 and a fourth section 740 (i.e., side sections 730 and 740) that extend along a Y axis. The two side sections 730 and 740 connect the two main section 710 and 720. Each of the four sections 710, 720, 730, and 740 have three conductor traces. The number of conductor traces can be adjusted based on desired resistance of the PCT coil assembly 500, total length of the coil 700, packing factor of the PCT coil assembly 500, or other factors. There is an insulative gap (i.e., trace gap 770) between the conductor traces. The trace gap 770 has a width in a range from 1 μm to 50 μm.

Each of the main sections 710 and 720 has a trace length 750 along the X axis and a trace width 760 along the Y axis. Each of the side sections 730 and 740 has a trace length 755 along the Y axis and a trace width 765 along the X axis. The trace length 750 is larger than the trace length 755. Also, the trace width 760 is larger than the trace width 765. Such a design maximizes the conductor traces along the X axis, so that after an input signal is applied to the coil 700, distribution of the input signal is maximized along the X axis to achieve high efficiency along the X axis.

In some embodiments, the trace length 750 is in a range from 5 mm to 25 mm. The trace width 760 is in a range from 45 μm to 2000 μm. A height of the coil 700 in a plane perpendicular to the X-Y plane is in a range from 8 μm to 50 μm.

Figure 8:
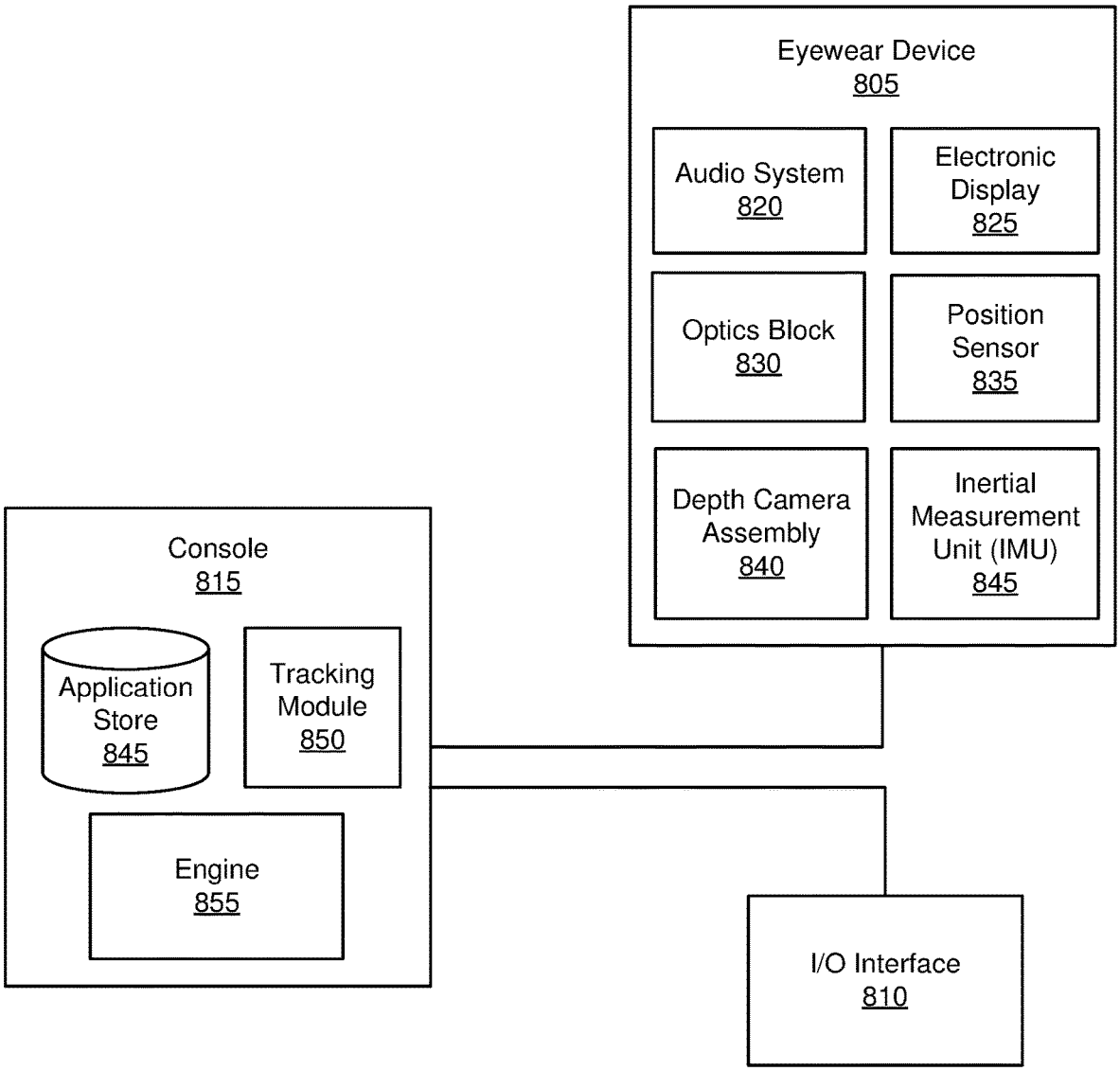
FIG. 8 illustrates a system environment of an eyewear device, in accordance with one or more embodiments.

FIG. 8 illustrates a system environment of an eyewear device, in accordance with one or more embodiments. The system 800 may operate in an artificial reality environment. The system 800 shown in FIG. 8 includes an eyewear device 805 and an input/output (I/O) interface 810 that is coupled to a console 815. While FIG. 8 shows an example system 800 including one eyewear device 805 and one I/O interface 88, in other embodiments any number of these components may be included in the system 800. For example, there may be multiple eyewear devices 805 each having an associated I/O interface 810 with each eyewear device 805 and I/O interface 810 communicating with the console 815. In alternative configurations, different and/or additional components may be included in the system 800. Additionally, functionality described in conjunction with one or more of the components shown in FIG. 8 may be distributed among the components in a different manner than described in conjunction with FIG. 8 in some embodiments. For example, some or all of the functionality of the console 815 is provided by the eyewear device 805.

In some embodiments, the eyewear device 805 may correct or enhance the vision of a user, protect the eye of a user, or provide images to a user. The eyewear device 805 may be eyeglasses which correct for defects in a user's eyesight. The eyewear device 805 may be sunglasses which protect a user's eye from the sun. The eyewear device 805 may be safety glasses which protect a user's eye from impact. The eyewear device 805 may be a night vision device or infrared goggles to enhance a user's vision at night. Alternatively, the eyewear device 805 may not include lenses and may be just a frame with an audio system 820 that provides audio (e.g., music, radio, podcasts) to a user.

In some embodiments, the eyewear device 805 may be a head-mounted display that presents content to a user comprising augmented views of a physical, real-world environment with computer-generated elements (e.g., two dimensional (2D) or three dimensional (3D) images, 2D or 3D video, sound, etc.). In some embodiments, the presented content includes audio that is presented via an audio system 820 that receives audio information from the eyewear device 805, the console 815, or both, and presents audio data based on the audio information. In some embodiments, the eyewear device 805 presents virtual content to the user that is based in part on a real environment surrounding the user. For example, virtual content may be presented to a user of the eyewear device. The user physically may be in a room, and virtual walls and a virtual floor of the room are rendered as part of the virtual content. In the embodiment of FIG. 8, the eyewear device 805 includes an audio system 820, an electronic display 825, an optics block 830, a position sensor 835, a depth camera assembly (DCA) 840, and an inertial measurement (IMU) unit 845. Some embodiments of the eyewear device 805 have different components than those described in conjunction with FIG. 8. Additionally, the functionality provided by various components described in conjunction with FIG. 8 may be distributed differently among the components of the eyewear device 805 in other embodiments or be captured in separate assemblies remote from the eyewear device 805.

The audio system 820 detects sound in a local environment surrounding the eyewear device 805. The audio system 820 may include a microphone array, a controller, and a speaker assembly, among other components. The microphone array detects sounds within a local area surrounding the microphone array. The microphone array may include a plurality of acoustic sensors that each detect air pressure variations of a sound wave and convert the detected sounds into an electronic format (analog or digital). The plurality of acoustic sensors may be positioned on an eyewear device (e.g., eyewear device 80), on a user (e.g., in an ear canal of the user), on a neckband, or some combination thereof. The speaker assembly provides audios content using, e.g., cartilage conduction and/or bone conduction technologies. Cartilage conduction and bone conduction systems are described in detail at, e.g., U.S. application Ser. No. 15/967,924, which is hereby incorporated by reference in its entirety. The speaker assembly includes one or more transducer systems used to provide audio content to the user of the eyewear device 805. The transducer systems could be any one of the transducer systems shown and described above and/or transducers coupled to suspension components as shown and described above.

In some embodiments, a transducer system includes a transducer (e.g., the high-efficiency motor 100 in FIG. 1A) that converts electrical energy and magnetic energy to mechanical energy. The transducer includes one or more coil assemblies (such as the MEMS coil assembly 200 in FIG. 2 or the PCB coil assembly 500 in FIG. 5) arranged between at least one pair of magnets. Input signals corresponding to the audio content are applied to the coil assemblies and causes a motive force (e.g., Lorenz forces) applied onto the coil assemblies so that the coil assemblies move orthogonally relatively to the magnets. An embodiment of the transducer system is the transducer system 150 in FIG. 1B. The transducer system can be implemented on an ear piece or an eye piece.

The electronic display 825 displays 2D or 3D images to the user in accordance with data received from the console 815. In various embodiments, the electronic display 825 comprises a single electronic display or multiple electronic displays (e.g., a display for each eye of a user). Examples of the electronic display 825 include: a liquid crystal display (LCD), an organic light emitting diode (OLED) display, an active-matrix organic light-emitting diode display (AMOLED), some other display, or some combination thereof.

The optics block 830 magnifies image light received from the electronic display 825, corrects optical errors associated with the image light, and presents the corrected image light to a user of the eyewear device 805. The electronic display 825 and the optics block 830 may be an embodiment of the lens 18. In various embodiments, the optics block 830 includes one or more optical elements. Example optical elements included in the optics block 830 include: an aperture, a Fresnel lens, a convex lens, a concave lens, a filter, a reflecting surface, or any other suitable optical element that affects image light. Moreover, the optics block 830 may include combinations of different optical elements. In some embodiments, one or more of the optical elements in the optics block 830 may have one or more coatings, such as partially reflective or anti-reflective coatings.

Magnification and focusing of the image light by the optics block 830 allows the electronic display 825 to be physically smaller, weigh less, and consume less power than larger displays. Additionally, magnification may increase the field of view of the content presented by the electronic display 825. For example, the field of view of the displayed content is such that the displayed content is presented using almost all (e.g., approximately 18 degrees diagonal), and in some cases all, of the user's field of view. Additionally, in some embodiments, the amount of magnification may be adjusted by adding or removing optical elements.

In some embodiments, the optics block 830 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display 825 for display is pre-distorted, and the optics block 830 corrects the distortion when it receives image light from the electronic display 825 generated based on the content.

The DCA 840 captures data describing depth information for a local area surrounding the eyewear device 805. In one embodiment, the DCA 840 may include a structured light projector, an imaging device, and a controller. The captured data may be images captured by the imaging device of structured light projected onto the local area by the structured light projector. In one embodiment, the DCA 840 may include two or more cameras that are oriented to capture portions of the local area in stereo and a controller. The captured data may be images captured by the two or more cameras of the local area in stereo. The controller computes the depth information of the local area using the captured data. Based on the depth information, the controller determines absolute positional information of the eyewear device 805 within the local area. The DCA 840 may be integrated with the eyewear device 805 or may be positioned within the local area external to the eyewear device 805. In the latter embodiment, the controller of the DCA 840 may transmit the depth information to a controller of the audio system 820.

The IMU 845 is an electronic device that generates data indicating a position of the eyewear device 805 based on measurement signals received from one or more position sensors 835. The one or more position sensors 835 may be an embodiment of the sensor device 115. A position sensor 835 generates one or more measurement signals in response to motion of the eyewear device 805. Examples of position sensors 835 include: one or more accelerometers, one or more gyroscopes, one or more magnetometers, another suitable type of sensor that detects motion, a type of sensor used for error correction of the IMU 845, or some combination thereof. The position sensors 835 may be located external to the IMU 845, internal to the IMU 845, or some combination thereof.

Based on the one or more measurement signals from one or more position sensors 835, the IMU 845 generates data indicating an estimated current position of the eyewear device 805 relative to an initial position of the eyewear device 805. For example, the position sensors 835 include multiple accelerometers to measure translational motion (forward/back, up/down, left/right) and multiple gyroscopes to measure rotational motion (e.g., pitch, yaw, and roll). In some embodiments, the IMU 845 rapidly samples the measurement signals and calculates the estimated current position of the eyewear device 805 from the sampled data. For example, the IMU 845 integrates the measurement signals received from the accelerometers over time to estimate a velocity vector and integrates the velocity vector over time to determine an estimated current position of a reference point on the eyewear device 805. Alternatively, the IMU 845 provides the sampled measurement signals to the console 815, which interprets the data to reduce error. The reference point is a point that may be used to describe the position of the eyewear device 805. The reference point may generally be defined as a point in space or a position related to the eyewear device's 805 orientation and position.

The IMU 845 receives one or more parameters from the console 815. As further discussed below, the one or more parameters are used to maintain tracking of the eyewear device 805. Based on a received parameter, the IMU 845 may adjust one or more IMU parameters (e.g., sample rate). In some embodiments, data from the DCA 840 causes the IMU 845 to update an initial position of the reference point so it corresponds to a next position of the reference point. Updating the initial position of the reference point as the next calibrated position of the reference point helps reduce accumulated error associated with the current position estimated the IMU 845. The accumulated error, also referred to as drift error, causes the estimated position of the reference point to "drift" away from the actual position of the reference point over time. In some embodiments of the eyewear device 805, the IMU 845 may be a dedicated hardware component. In other embodiments, the IMU 845 may be a software component implemented in one or more processors.

The I/O interface 810 is a device that allows a user to send action requests and receive responses from the console 815. An action request is a request to perform a particular action. For example, an action request may be an instruction to start or end capture of image or video data, start or end the audio system 820 from producing sounds, start or end a calibration process of the eyewear device 805, or an instruction to perform a particular action within an application. The I/O interface 810 may include one or more input devices. Example input devices include: a keyboard, a mouse, a game controller, or any other suitable device for receiving action requests and communicating the action requests to the console 815. An action request received by the I/O interface 810 is communicated to the console 815, which performs an action corresponding to the action request. In some embodiments, the I/O interface 815 includes an IMU 845, as further described above, that captures calibration data indicating an estimated position of the I/O interface 810 relative to an initial position of the I/O interface 810. In some embodiments, the I/O interface 810 may provide haptic feedback to the user in accordance with instructions received from the console 815. For example, haptic feedback is provided when an action request is received, or the console 815 communicates instructions to the I/O interface 810 causing the I/O interface 810 to generate haptic feedback when the console 815 performs an action.

The console 815 provides content to the eyewear device 805 for processing in accordance with information received from one or more of: the eyewear device 805 and the I/O interface 810. In the example shown in FIG. 8, the console 815 includes an application store 845, a tracking module 850, and an engine 855. Some embodiments of the console 815 have different modules or components than those described in conjunction with FIG. 8. Similarly, the functions further described below may be distributed among components of the console 815 in a different manner than described in conjunction with FIG. 8.

The application store 845 stores one or more applications for execution by the console 845. An application is a group of instructions, that when executed by a processor, generates content for presentation to the user. Content generated by an application may be in response to inputs received from the user via movement of the eyewear device 805 or the I/O interface 810. Examples of applications include: gaming applications, conferencing applications, video playback applications, calibration processes, or other suitable applications.

The tracking module 850 calibrates the system environment 800 using one or more calibration parameters and may adjust one or more calibration parameters to reduce error in determination of the position of the eyewear device 805 or of the I/O interface 810. Calibration performed by the tracking module 850 also accounts for information received from the IMU 845 in the eyewear device 805 and/or an IMU 845 included in the I/O interface 810. Additionally, if tracking of the eyewear device 805 is lost, the tracking module 850 may re-calibrate some or all of the system environment 800.

The tracking module 850 tracks movements of the eyewear device 805 or of the I/O interface 810 using information from the one or more sensor devices 835, the IMU 845, or some combination thereof. For example, the tracking module 850 determines a position of a reference point of the eyewear device 805 in a mapping of a local area based on information from the eyewear device 805. The tracking module 850 may also determine positions of the reference point of the eyewear device 805 or a reference point of the I/O interface 810 using data indicating a position of the eyewear device 805 from the IMU 845 or using data indicating a position of the I/O interface 810 from an IMU 845 included in the I/O interface 88, respectively. Additionally, in some embodiments, the tracking module 850 may use portions of data indicating a position or the eyewear device 805 from the IMU 845 to predict a future location of the eyewear device 805. The tracking module 850 provides the estimated or predicted future position of the eyewear device 805 or the I/O interface 810 to the engine 855.

The engine 855 also executes applications within the system environment 800 and receives position information, acceleration information, velocity information, predicted future positions, audio information, or some combination thereof of the eyewear device 805 from the tracking module 850. Based on the received information, the engine 855 determines content to provide to the eyewear device 805 for presentation to the user. For example, if the received information indicates that the user has looked to the left, the engine 855 generates content for the eyewear device 805 that mirrors the user's movement in a virtual environment or in an environment augmenting the local area with additional content. Additionally, the engine 855 performs an action within an application executing on the console 815 in response to an action request received from the I/O interface 810 and provides feedback to the user that the action was performed. The provided feedback may be visual or audible feedback via the eyewear device 805 or haptic feedback via the I/O interface 810.

Figure 9:
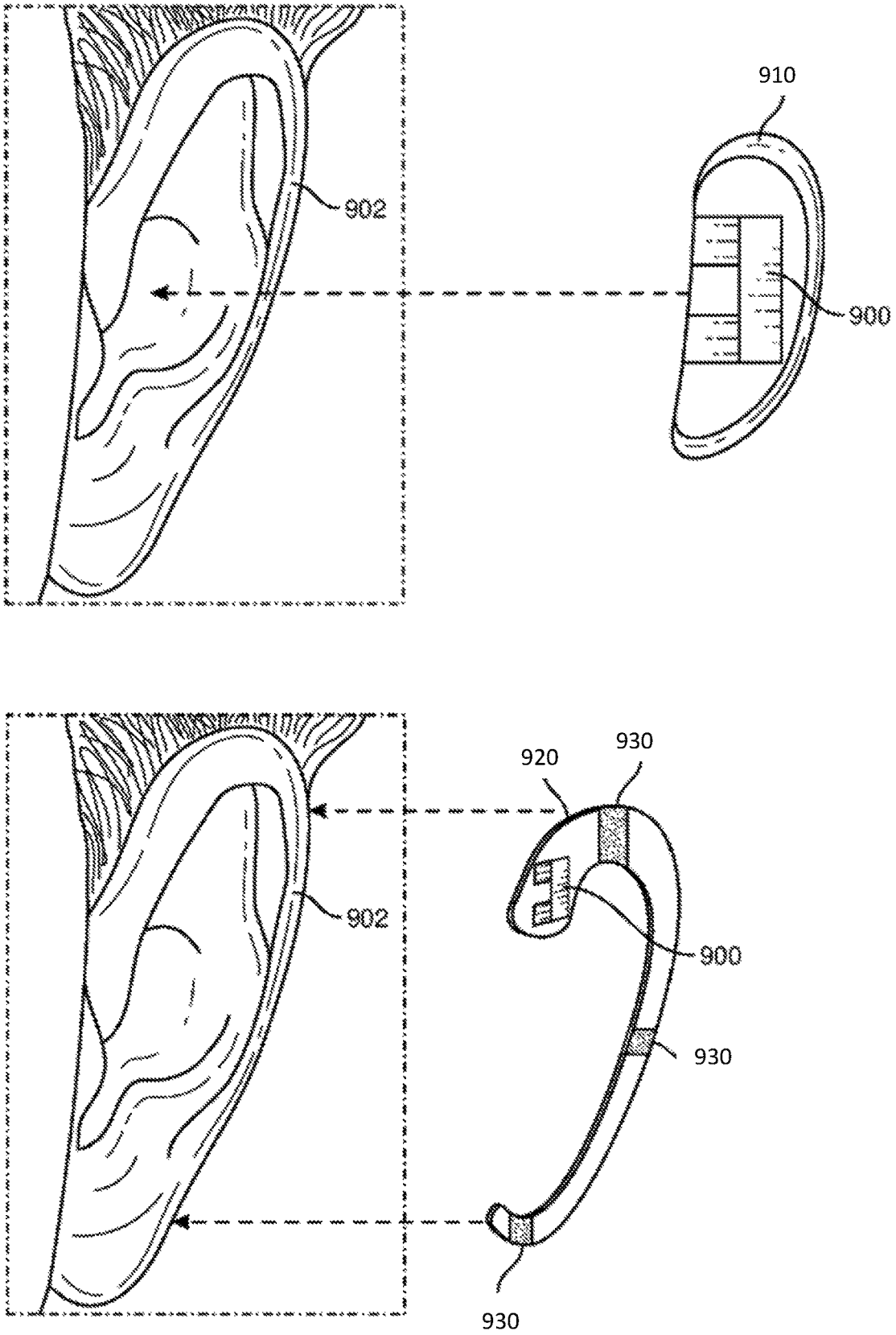
FIG. 9 illustrates ear pieces where a high-efficiency motor is implemented, in accordance with one or more embodiments.

FIG. 9 illustrates ear pieces 910 and 920 where a high-efficiency motor 900 is implemented, in accordance with one or more embodiments. An embodiment of the high-efficiency motor 900 is the high-efficiency motor 100 in FIG. 1A. The high-efficiency motor 900 is sized small enough to fit inside the inner ear piece 910 and the outer ear piece 920. In some embodiments, components of the high-efficiency motor 900 may be sized to fit within a relatively small form factor that is light, compact and unobtrusive.

In some embodiments, the high-efficiency motor 900 is inserted into or built into an inner ear piece 910 designed for insertion into a user's ear 902. The inner ear piece 910 is designed to sit comfortably inside the user's ear. In such a position, the high-efficiency motor 900 may vibrate a rigid structure that includes or attached with a coil, such that it vibrates the user's ear 902. The inner ear piece 910 is configured to allow the high-efficiency motor 900 to vibrate the user's pinna and/or tragal cartilage. In some cases, the rigid structure of the high-efficiency motor 900 may be faced in one direction to apply more force to the user's tragal cartilage, and in the other direction, the rigid member may apply more force to the user's pinna cartilage.

In some embodiments, the high-efficiency motor 900 is inserted into or built into an outer ear piece 920. The outer ear piece 920 is designed to fit between the user's ear 902 and head. The outer ear piece 912 allows the high-efficiency motor 900 to vibrate the user's pinna from behind the ear 902. In some embodiments, the outer ear piece 920 may be coupled to the user's ear via sticky pads 930 that grip the user's skin and hold the system in place behind the user's ear.

Figure 10:
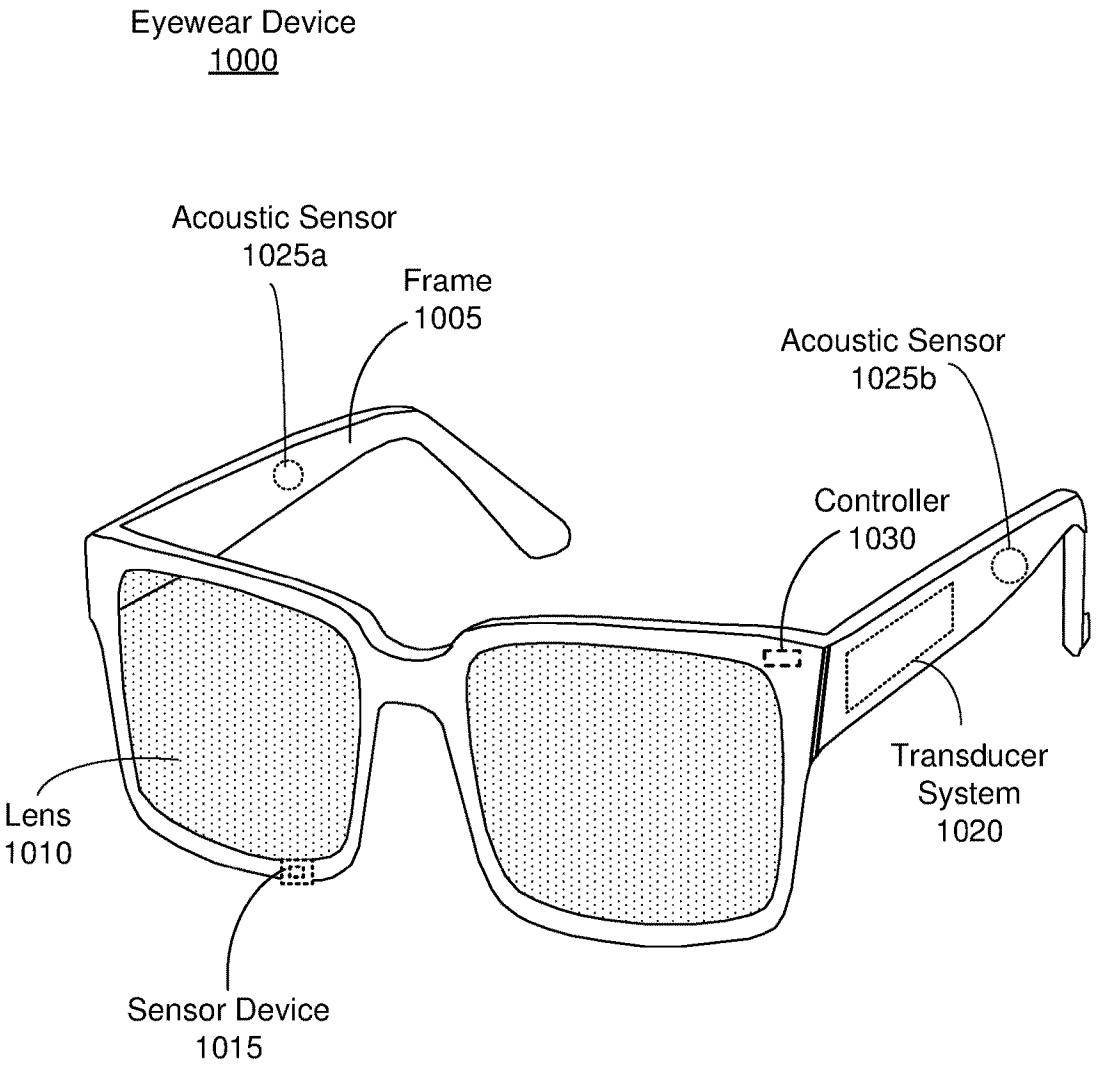
FIG. 10 illustrates an eyewear device where a transducer system is implemented, in accordance with one or more embodiments.

FIG. 10 illustrates an eyewear device 1000 where a transducer system 1020 is implemented, in accordance with one or more embodiments. The eyewear device 1000 is an embodiment of the eyewear device 805 described in conjunction with FIG. 8. The eyewear device 1000 presents media to a user. Examples of media presented by the eyewear device 1000 include one or more images, video, audio, or some combination thereof. In one embodiment, the eyewear device 1000 may be a near-eye display (NED). In embodiments (not shown) the eyewear device 1000 may be a head-mounted display. The eyewear device 1000 may include, among other components, a frame 1005, a lens 1400, a sensor device 1405, an audio system, and a transducer system 1020. The audio system may include, among other components, one or more acoustic sensors 1105 and a controller 1300. The transducer system may include, among other components, a transducer and a vibration isolation system, discussed in FIG. 1B. While FIG. 10 illustrates the components of the eyewear device 1000 in example locations on the eyewear device 1000, the components may be located elsewhere on the eyewear device 1000, on a peripheral device paired with the eyewear device 1000, or some combination thereof.

The eyewear device 1000 may correct or enhance the vision of a user, protect the eye of a user, or provide images to a user. The eyewear device 1000 may be eyeglasses which correct for defects in a user's eyesight. The eyewear device 1000 may be sunglasses which protect a user's eye from the sun. The eyewear device 1000 may be safety glasses which protect a user's eye from impact. The eyewear device 1000 may be a night vision device or infrared goggles to enhance a user's vision at night. The eyewear device 1000 may be a near-eye display that produces VR, AR, or MR content for the user. Alternatively, the eyewear device 1000 may not include a lens 1400 and may be a frame 1005 with an audio system that provides audio (e.g., telephony, alerts, media, music, radio, podcasts) to a user.

The frame 1005 includes a front part that holds the lens 1400 and end pieces to attach to the user. The front part of the frame 1005 bridges the top of a nose of the user. The end pieces (e.g., temples) are portions of the frame 1005 that hold the eyewear device 1000 in place on a user (e.g., each end piece extends over a corresponding ear of the user). The length of the end piece may be adjustable to fit different users. The end piece may also include a portion that curls behind the ear of the user (e.g., temple tip, ear piece).

The lens 1400 provides or transmits light to a user wearing the eyewear device 1000. The lens 1400 may be prescription lens (e.g., single vision, bifocal and trifocal, or progressive) to help correct for defects in a user's eyesight. The prescription lens transmits ambient light to the user wearing the eyewear device 1000. The transmitted ambient light may be altered by the prescription lens to correct for defects in the user's eyesight. The lens 1400 may be a polarized lens or a tinted lens to protect the user's eyes from the sun. The lens 1400 may be one or more waveguides as part of a waveguide display in which image light is coupled through an end or edge of the waveguide to the eye of the user. The lens 1400 may include an electronic display for providing image light and may also include an optics block for magnifying image light from the electronic display. Additional detail regarding the lens 1400 is discussed with regards to FIG. 9. The lens 1400 is held by a front part of the frame 1005 of the eyewear device 1000.

The sensor device 1405 generates one or more measurement signals in response to motion of the eyewear device 1000. The sensor device 1405 may be located on a portion of the frame 1005 of the eyewear device 1000. The sensor device 1405 may include a position sensor, an inertial measurement unit (IMU), or both. Some embodiments of the eyewear device 1000 may or may not include the sensor device 1405 or may include more than one sensor device 1405. In embodiments in which the sensor device 1405 includes an IMU, the IMU generates fast calibration data based on measurement signals from the sensor device 1405. Examples of sensor devices 1405 include: one or more accelerometers, one or more gyroscopes, one or more magnetometers, another suitable type of sensor that detects motion, a type of sensor used for error correction of the IMU, or some combination thereof. The sensor device 1405 may be located external to the IMU, internal to the IMU, or some combination thereof. The sensor device 1405 may include multiple accelerometers to measure translational motion (forward/back, up/down, left/right) and multiple gyroscopes to measure rotational motion (e.g., pitch, yaw, roll).

The audio system detects and processes sounds within an environment surrounding the eyewear device 1000. Some embodiments of the eyewear device 1000 may or may not include the audio system. In the embodiment of FIG. 10, the audio system includes the plurality of acoustic sensors 1105 and the controller 1300. Each acoustic sensor is configured to detect sounds within a local area surrounding the microphone array. In some embodiments, some of the plurality of acoustic sensors 1105 are coupled to a neckband coupled to the eyewear device 1000. The controller 1300 is configured to process the data collected by the acoustic sensors 1105. The controller 1300 may transmit data and commands to and from an artificial reality system. In some embodiments, the acoustic sensors 1105 may provide audio feedback to a user in response to commands received from the artificial reality system.

The transducer system 1020 is coupled to the frame 1005. As shown in FIG. 10, the transducer system 1020 is located on a temple arm of the eyewear device 1000. In some other embodiments, the transducer system 1020 is located at the portion of the temple arm that curves behind the wearer's ear. In some embodiments, the transducer system 1020 includes a transducer with an integrated vibration isolation system. The transducer is a component that converts a signal from one energy form to another energy form. Examples of transducers includes microphones, position sensors, pressure sensors, actuators, haptic engines, vibration alerts, speakers, tissue conduction, among others. The vibration isolation system isolates the vibrations produced by the transducer from a device to which the vibration isolation system is attached and/or coupled. In the embodiment of FIG. 10, the vibration isolation system isolates vibrations from the frame 1005. Isolating vibrations produced by the transducer reduces the transmission of the vibrations to a user wearing the eyewear device 1000, to other components of the eyewear device 1000, or some combination thereof. An embodiment of the transducer system 1020 is the transducer system 150 described in conjunction with FIG. 1B.

In some embodiments, the transducer system 1020 is used to provide audio content to the user. Audio content may be, e.g., airborne audio content and/or tissue born audio content. For example, airborne audio content (i.e., sounds) may be generated by the transducer system being coupled to a diaphragm that vibrates with a transducer in the transducer system. The moving diaphragm generating the airborne audio content. In contrast, tissue born audio content provides audio content using tissue conduction. Tissue conduction includes one or both of bone conduction and cartilage conduction, that vibrates bone and/or cartilage to generate acoustic pressure waves in a tissue of a user.

A bone conduction audio system uses bone conduction for providing audio content to the ear of a user while keeping the ear canal of the user unobstructed. The bone conduction audio system includes a transducer assembly that generates tissue born acoustic pressure waves corresponding to the audio content by vibrating tissue in a user's head that includes bone. Tissue may include e.g., bone, cartilage, muscle, skin, etc. For bone conduction, the primary pathway for the generated acoustic pressure waves is through the bone of the head (bypassing the eardrum) directly to the cochlea. The cochlea turns tissue borne acoustic pressure waves into signals which the brain perceives as sound.

A cartilage conduction audio system uses cartilage conduction for providing audio content to an ear of a user. The cartilage conduction audio system includes a transducer assembly that is coupled to one or more portions of the auricular cartilage around the outer ear (e.g., the pinna, the tragus, some other portion of the auricular cartilage or tissue, or some combination thereof). The transducer assembly generates airborne acoustic pressure waves corresponding to the audio content by vibrating the one or more portions of the auricular cartilage. This airborne acoustic pressure wave may propagate toward an entrance of the ear canal where it would be detected by the ear drum. However, the cartilage conduction audio system is a multipath system that generates acoustic pressure waves in different ways. For example, vibrating the one or more portions of auricular cartilage may generate: airborne acoustic pressure waves outside the ear canal; tissue born acoustic pressure waves that cause some portions of the ear canal to vibrate thereby generating an airborne acoustic pressure wave within the ear canal; or some combination thereof. Additional details regarding bone conduction and/or cartilage conduction may be found at, e.g., U.S. patent application Ser. No. 15/967,924, filed on May 1, 20108, which in incorporated by reference in its entirety.

Figure 11:
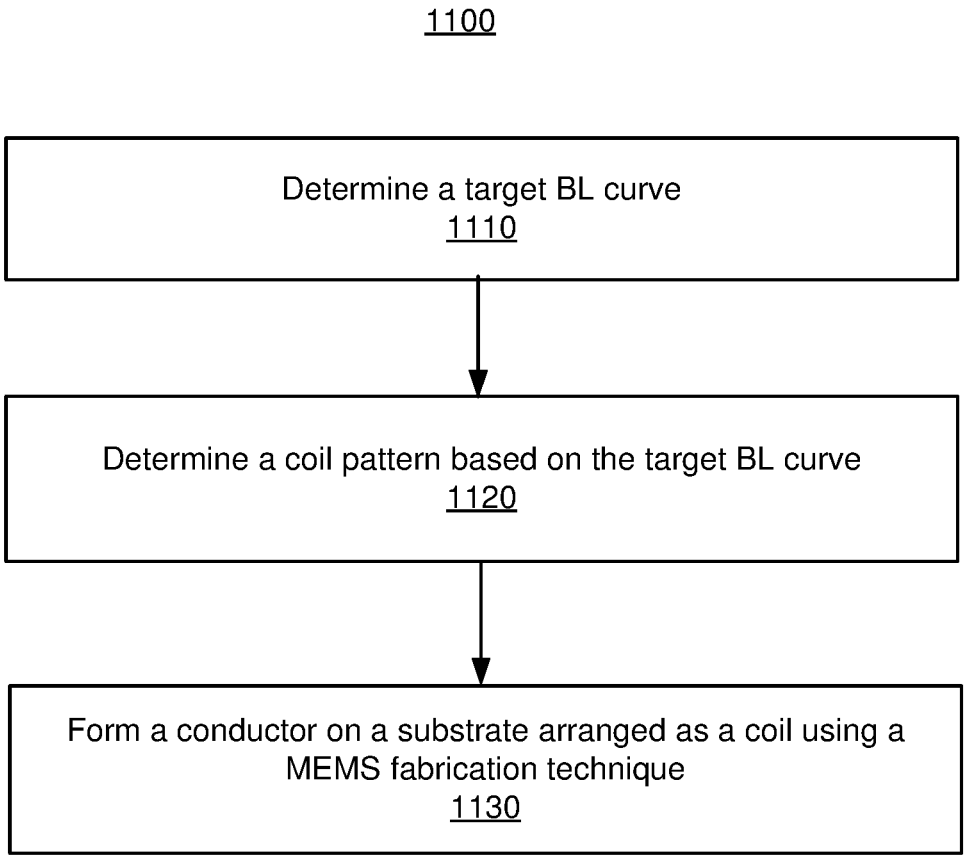
FIG. 11 is a flowchart illustrating a process for manufacturing a MEMS coil assembly, in accordance with one or more embodiments.

FIG. 11 is a flowchart illustrating a process 1100 for manufacturing a MEMS coil assembly, in accordance with one or more embodiments. An embodiment of the MEMS coil assembly is the MEMS coil assembly 200 in FIG. 2. Embodiments of the process 1100 may include different and/or additional steps, or perform the steps in different orders.

The process 1100 includes determining 1110 a target BL curve. The target BL curve can be a linearized BL curve (e.g., the linearized BL curve 420) or a highly non-linearized BL curve (e.g., the highly non-linearized BL curve 430).

The process 1100 also includes determining 1120 a coil pattern based on the target BL curve. The coil pattern can include shapes of conductor traces, lengths of conductor traces, widths of conductor traces, number of conductors, etc.

The process 1100 further includes forming 1130 a conductor having the coil pattern on a substrate using a MEMS fabrication technique. In some embodiments, dimensions of the conductor have a resolution less than 1 μm.

Additional Configuration Information

The foregoing description of the embodiments of the disclosure have been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A microelectromechanical system (MEMS) coil assembly, comprising:

a substrate; and a plurality of coil segments, each coil segment comprising:

a portion of the substrate, a first conductor arranged on the portion of the substrate to form a first coil, and a second conductor arranged on the portion of the substrate to form a second coil, wherein the substrate is folded to stack the plurality of coil segments on top of each other and electrically connect first conductors and second conductors of adjacent coil segments of the plurality coil segments, and the MEMS coil assembly has a packing factor equal to or above 90%.

2. The MEMS coil assembly of claim 1, wherein each coil segment further comprises a layer of a heat mitigating material configured to mitigate heat generated from operation of the MEMS coil assembly.

3. The MEMS coil assembly of claim 1, wherein dimensions of traces of the first and second conductors of each coil segment have a precision of less than 1 μm.

4. The MEMS coil assembly of claim 1, wherein a gap between traces of the first and second conductors of each coil segment has a width in a range from 400 μm to 500 μm.

5. The MEMS coil assembly of claim 1, wherein the MEMS coil assembly has a length in a range from 20 mm to 25 mm and a width in a range from 3 mm to 8 mm.

6. The MEMS coil assembly of claim 1, wherein an impedance of the MEMS coil assembly is in a range from 1Ω to 350Ω.

7. The MEMS coil assembly of claim 1, wherein an inductance of the MEMS coil assembly is in a range from 10 μH to 100 μH.

8. The MEMS coil assembly of claim 1, wherein the substrate comprises parylene or polyimide.

9. The MEMS coil assembly of claim 1, wherein traces of the first and second conductors of each coil segment have a shape selected from a group consisting of race track, round, circle, oval, rectangular, spiral, and serpentine.

10. An electromagnetic motor comprising:

at least two magnets; and a microelectromechanical system (MEMS) coil assembly arranged between the at least two magnets, the MEMS coil assembly comprising:

a substrate, and a plurality of coil segments, each coil segment comprising a portion of the substrate of the plurality of substrate portions, a first conductor arranged on the portion of the substrate to form a first coil, and a second conductor arranged on the portion of the substrate to form a second coil, wherein the substrate is folded to stack the plurality of coil segments on top of each other and electrically connect first conductors and second conductors of adjacent coil segments of the plurality coil segments; and wherein the MEMS coil assembly moves relative to the magnets in response to an input signal.

11. The electromagnetic motor of claim 10, wherein a transducer that provides audio content to a user of a headset comprises the electromagnetic motor.

12. The electromagnetic motor of claim 10, further comprising a rigid structure to which the MEMS coil assembly is attached, the rigid structure configured to provide mechanical support to the MEMS coil assembly and move together with the MEMS coil assembly.

13. The electromagnetic motor of claim 10, wherein the MEMS coil assembly has a packing factor equal to or above 90%.

14. The electromagnetic motor of claim 10, wherein dimensions traces of the first and second conductors of each coil segment have a precision of less than 1 μm.

15. The electromagnetic motor of claim 10, wherein a gap between traces of the first and second conductors of each coil segment has a width in a range from 400 μm to 500 μm.

16. The electromagnetic motor of claim 10, wherein an impedance of the MEMS coil assembly is in a range from 1Ω to 350Ω.

17. The MEMS coil assembly of claim 1, wherein an inductance of the MEMS coil assembly is in a range from 10 μH to 100 μH.

18. The electromagnetic motor of claim 10, wherein the substrate comprises parylene or polyimide.

19. The electromagnetic motor of claim 10, wherein traces of the first and second conductors of each coil segment have a shape selected from a group consisting of race track, round, circle, oval, rectangular, spiral, and serpentine.

* * * * *